US005331112A

United States Patent [19]

Sato et al.

[11] Patent Number: 5,331,112

[45] Date of Patent: Jul. 19, 1994

[54] APPARATUS FOR CROSS-CORRELATING ADDITIONAL MUSICAL PART TO PRINCIPAL PART THROUGH TIME

[75] Inventors: Jun Sato; Junichi Minamitaka, both of Fussa, Japan

[73] Assignee: Casio Computer Co., Ltd., Tokyo, Japan

[21] Appl. No.: 7,119

[22] Filed: Jan. 21, 1993

Related U.S. Application Data

[63] Continuation of Ser. No. 588,050, Sep. 25, 1990.

[30] Foreign Application Priority Data

| | | | |
|---|---|---|---|
| Sep. 29, 1989 | [JP] | Japan | 1-252405 |
| Dec. 30, 1989 | [JP] | Japan | 1-341502 |
| Dec. 30, 1989 | [JP] | Japan | 1-341506 |
| Dec. 30, 1989 | [JP] | Japan | 1-341507 |
| Dec. 30, 1989 | [JP] | Japan | 1-341508 |

[51] Int. Cl.[5] ..... G10H 7/00; G04B 13/00; A63H 5/00

[52] U.S. Cl. ..... 84/609; 84/613; 84/637

[58] Field of Search ..... 84/609-616, 84/634-638, 649-652, 654

[56] References Cited

U.S. PATENT DOCUMENTS

| | | | |
|---|---|---|---|
| 4,470,332 | 9/1984 | Aoki | 84/666 |
| 4,489,636 | 12/1984 | Aoki et al. | 84/DIG. 2 X |
| 4,519,286 | 5/1985 | Hall et al. | 84/613 |
| 4,543,869 | 10/1985 | Kawashima et al. | 84/610 |
| 4,896,576 | 1/1990 | Ino | 84/634 |
| 4,982,643 | 1/1991 | Minamitaka | 84/613 |
| 5,003,860 | 4/1991 | Minamitaka | 84/609 |

*Primary Examiner*—William M. Shoop, Jr.
*Assistant Examiner*—Jeffrey W. Donels
*Attorney, Agent, or Firm*—Frishauf, Holtz, Goodman & Woodward

[57] ABSTRACT

An apparatus automatically generates an additional musical part which varies as a function of a given principal part of a music piece. In an embodiment, the apparatus adds a melodic part with a varying pitch line of an arpeggio each element of which is a selected chord tone having a pitch associated with a time-shifted pitch of the principal part. As a result, a "canon" or "Fugue" polyphonic music is obtained.

6 Claims, 29 Drawing Sheets

| | | |
|---|---|---|
| T: | CURRENT TIME | INTEGER |
| TM: | MELODY TIME REFERENCED BY SUBSIDIARY PART | INTEGER |
| F: | DIRECTION OF PITCH DISTANCE FROM MELODY TO SUBSIDIARY PART | INTEGER |
| L: | MAGNITUDE OF PITCH DISTANCE FROM MELODY TO SUBSIDIARY PART | INTEGER |
| CR: | CURRENT CHORD ROOT | MELODY TYPE |
| CT: | CURRENT CHORD TYPE | CHORD TYPE |
| EL: | CURRENT SUBSIDIARY PART | MELODY TYPE |
| MD[ ]: | MELODY NOTE ARRAY | MELODY TYPE |
| CKT[ ]: | CHORD MEMBER TABLE | MELODY TYPE |
| CLK: | BAR TIME RESOLUTION (96) | INTEGER |
| LINE: | LINE NUMBER | INTEGER |
| MAXLINE: | TOTAL LINE NUMBER OF SUBSIDIARY PART | INTEGER |
| MDN: | SIZE OF MELODY NOTE ARRAY | INTEGER |

FIG. 2

| MELODY TYPE | |
|---|---|
| OFF | - 1 |
| C2 | 0 |
| C#2 | 1 |
| D2 | 2 |
| D#2 | 3 |
| ⋮ | |

| CHORD TYPE | |
|---|---|
| MAJ | 0 |
| MIN | 1 |
| MIN7 | 2 |
| MAJ7 | 3 |
| ⋮ | |

FIG. 3

| | | | |
|---|---|---|---|
| CKT[0] | 0 | (C) | MAJ |
| CKT[1] | 4 | (E) | |
| CKT[2] | 7 | (G) | |
| CKT[3] | - 1 | OFF | |
| CKT[4] | 0 | (C) | MIN |
| CKT[5] | 3 | (Eb) | |
| CKT[6] | 7 | (G) | |
| CKT[7] | - 1 | OFF | |
| CKT[8] | 0 | (C) | MAJ7 |
| CKT[9] | 4 | (E) | |
| CKT[10] | 7 | (G) | |
| CKT[11] | 1 1 | (B) | |
| CKT[12] | 0 | (C) | MIN7 |
| CKT[13] | 3 | (Eb) | |
| CKT[14] | 7 | (G) | |
| CKT[15] | 1 0 | (Bb) | |

FIG. 4

| | | |
|---|---|---|
| T: | CURRENT TIME | INTEGER |
| BAR: | LAG TIME REFERENCE | INTEGER |
| D: | PHASE CONTROL | INTEGER |
| CLK: | MUSICAL TIME RESOLUTION | INTEGER |
| TM: | SUBSIDIARY PART TIME | INTEGER |
| CR: | CURRENT CHORD ROOT | MELODY TYPE |
| CT: | CURRENT CHORD TYPE | CHORD TYPE |
| EL: | CURRENT SUBSIDIARY PART | MELODY TYPE |
| MD[ ]: | MELODY NOTE ARRAY | MELODY TYPE |
| MDN: | SIZE OF MELOY NOTE ARRAY | INTEGER |
| CKT[ ]: | CHORD MEMBER TABLE | MELODY TYPE |

FIG.15

| | | |
|---|---|---|
| T: | CURRENT TIME | INTEGER |
| CR: | CURRENT CHORD ROOT | MELODY TYPE |
| CT: | CURRENT CHORD TYPE | CHORD TYPE |
| EL: | CURRENT SUBSIDIARY PART | MELODY TYPE |
| MD0[ ]: | MELODY NOTE ARRAY | MELODY TYPE |
| MD1[ ]: | QUANTIZED MELODY NOTE ARRAY | MELODY TYPE |
| CKT[ ]: | CHORD MEMBER TABLE | MELODY TYPE |

FIG. 20

APPARATUS FOR CROSS-CORRELATING ADDITIONAL MUSICAL PART TO PRINCIPAL PART THROUGH TIME

This is a continuation of application Ser. No. 07/588,050 filed Sep. 25, 1990.

BACKGROUND OF THE INVENTION

The present invention relates in general to music systems and in particular to an apparatus for generating an additional musical part.

Automatic accompaniment apparatus which generate and play an accompaniment line or subsidiary melody such as countermelody, obbligato, bass line and arpeggio are known. Such apparatus have been incorporated in electronic musical instruments to provide an automatic accompanying function. Typically, a melody (principal part, principal melodic part) is input from a melody keyboard while a chord progression (a succession of chords) is input from an accompaniment keyboard. From the chord progression, the apparatus generates a subsidiary melody. Then a tone generator of the apparatus outputs tones of the subsidiary melody as well as tones of the principal melody.

To generate a subsidiary melody, the prior art apparatus includes stored patterns called accompaniment patterns. Each accompaniment pattern essentially comprises a time (horizontal, durational, rhythm) component i.e., rhythm pattern and pitch line (vertical) component i.e., pitch pattern. In many cases, each accompaniment pattern is provided for a different one of rhythms selected from an input unit of the automatic accompaniment apparatus. Thus, once a particular rhythm has been selected, the apparatus repeats the same rhythm pattern (tone durational series) of the accompaniment without any interaction with a principal melody. Repeating the same, rhythm will give a mechanical impression on users.

The other component of the accompaniment pattern i.e., pitch pattern is represented either by a succession of abstract pitches or by a succession of normalized pitches before chord modification.

In a prior art apparatus, a stored pitch pattern is given by a succession of pitches to be played for a particular chord such as C major. In operation, when detecting a chord from the accompaniment keyboard, the apparatus selectively modifies the stored pitch pattern using the type and root of the detected chord to provide the actual pitch line of a subsidiary melody. This arrangement saves the amount of the stored pitch pattern data required for accompaniment. However, the resultant subsidiary (accompanying) melody tends to be monotonous because the actually performed pitch lines are fixedly associated with chords in a one-to-one correspondence.

In another prior art apparatus, each element of a stored pitch pattern (pitch, vertical component of a note) is represented by a chord member identifier. In operation, when detecting a current chord from a chord progression input unit, the apparatus uses the pitch data of members of the current chord to decode each element of the stored pitch pattern (i.e., chord member identifier) for conversion into a concrete pitch. Suppose, for example, a chord with a first member of pitch C, a second member of pitch E, and a third member of pitch A. Then, an element of the stored pitch pattern indicative of a third chord member identifier is converted into a pitch A. This arrangement has the same monotonous problem with the first mentioned prior art because the accompanying subsidiary melody depends only on the chord progression.

Still another prior art apparatus is designed to play a block chord performance with a principal melodic part. This apparatus synchronizes the rhythm of the accompaniment with that of the principal melody by directly using note-ons and offs of the principal melody as those of the accompaniment. The pitches of the accompaniment are formed by chord members having a predetermined pitch relation with a current melody note; for example, the highest chord member is vertically located just below the current melody note. As a result, the melody part and the accompaniment are integrated into a block chord performance in which all pitches are attacked simultaneously. Note, however, that such a block chord performance is a rather unordinary performance and results in a homophonic music. The prior art just stated has no capability of playing a performance having a principal melodic part and an additional melodic part recognized as distinct musical parts from each other.

In polyphonic music pieces composed by human composers, one will find good interactions between musical parts. No successful knowledge representation of interactions among musical parts is known yet. The prior art has disregarded the part-part interactions, or oversimplified them when designing a computer based music system.

SUMMARY OF THE INVENTION

Therefore, a general object of the invention is to provide an apparatus which automatically generates a natural and realistic subsidiary or additional musical part.

A specific object of the invention is to provide an apparatus which automatically generates an additional melodic part having a pitch line suitably correlated in time with that of a given principal part or other melodic part of a music piece.

Another specific object of the invention is to provide an apparatus which automatically generates an additional musical part having a rhythm suitably correlated in time with that of a given principal part or other musical part.

Still another object of the invention is to provide an apparatus which generates an additional melodic part that varies with and is influenced in time by a first given melodic part with respect to both pitch line and rhythm (tone durational series).

A further object of the invention is to provide an apparatus which generates an additional melodic part having a rhythm component that is affected by that of a performed principal melodic part while compensating for timing errors in the principal melodic part performance to correct the rhythm component of the additional melodic part.

In accordance with an aspect of the invention, there is provided an apparatus for generating an additional melodic part which comprises:

first part providing means for providing a first melodic part of a music piece;

pitch set succession providing means for providing a succession of pitch sets available in a second melodic part of the music piece; and second part generating means for generating the second melodic part as an additional melodic part in such a manner that a current pitch of the second melodic part is determined as a function of a current pitch set of the succession and pitch contents of the first melodic part indicative of a past pitch, a future pitch or a combination of pitches at different time points, of the first melodic part.

With this arrangement, the second (additional) melodic part interacts with the first (principal) melodic part by time factors. Even if the pitch set succession providing means provides a fixed succession of pitch sets, the resultant second melodic part varies much as a function of the principal melodic part through time. This overcomes the monotonous problem of the prior art accompaniment.

The succession of pitch sets may take a form of a chord progression (i.e., succession of chords).

An embodiment of the apparatus comprises: principal part providing means for providing (data of) a principal melodic part; chord progression providing means for providing (data of) a chord progression; and additional part generating means for generating an additional melodic part having at least one (individual) melodic line. The additional part generating means includes pitch determining means which determines a current pitch of the additional melodic part as a function of a current chord of the chord progression and a past pitch of the principal melodic part.

With this arrangement, the additional melodic part is led in time by the principal melodic part so that a "canon" or "Fugue" music is obtained.

In an environment in which a principal (melodic) part is given in advance, a future pitch of the principal melodic part may be referenced as a parameter to determine a current pitch of the additional melodic part. In this case, another "canon" or "Fugue" music is obtained with the additional melodic part leading the principal part.

In another embodiment, a combination of pitches of the principal tones at a plurality of different time points (having predetermined time differences from a current time) may serve as parameters affecting a current pitch of the additional melodic part.

This simulates more general interactions between a principal melodic part and an additional melodic part. A reference pitch may be determined by a linear function of a combination of pitches of the principal part. A current pitch of the additional part is determined as a function of the reference pitch and a current chord of the chord progression.

In an embodiment, the pitch determining means determines a current pitch of the additional melodic part by a pitch member of a current chord that has a predetermined pitch relationship with (e.g., closest to) the affecting pitch element of the principal melodic part.

In accordance with another aspect of the invention, there is provided an apparatus for generating an additional musical part comprising: first part providing means for providing a first part of a music piece; and second part rhythm generating means for generating a rhythm of a second (additional) part of the music piece by determining a current note duration of the second part as a function of at least one note duration of the first part which is selected from a past note duration, a future note duration or a combination of note durations at different time points, of the first part.

With this arrangement, the second part will have a rhythm associated with that of the first part by a link of time factors. This simulates rhythmic interactions between or among musical parts in polyphonic music.

The second part may be either a melodic part or a pure rhythmic part without varying pitches. In the latter case, the apparatus provides an automatic rhythm generator which generates a rhythm as a function of a given musical part.

In some applications, it is desired to play a real-time performance of principal and additional melodic parts in response to a chord progression and the principal melody performance data supplied in real-time.

To this end, an embodiment of the invention provides an apparatus for generating an additional melodic part which comprises:

principal part input means for inputting principal melodic part performance data of a music piece on a real-time basis;

principal part output means responsive to the principal part input means for outputting tones of the principal melodic part;

principal part storing means for storing principal melodic part performance data from the principal part input means;

chord progression input means for inputting a chord progression of the music piece on a real-time basis;

current chord detecting means responsive to the chord progression means for detecting a current chord;

additional melodic part generating means for generating a additional melodic part, the additional melodic part generating means including means for determining, on a real-time basis, a current pitch of the additional melodic part as a function of the current chord detected by the current chord detecting means and a pitch in the principal melodic part performance data stored in the principal part storing means, the pitch being existent at a predetermined past time; and additional melodic part output means responsive to the additional melodic part generating means for outputting tones of the additional melodic part.

The additional melodic part generating means may further comprise duration determining means for determining, on a real-time basis, a current note duration of the additional melodic part from a note duration at the predetermined past time (measured from a current time) in the stored principal melodic part performance data. With this arrangement, both the pitch line (vertical variation) and rhythm (horizontal variation) of the additional melodic part assimilate to past elements of the principal melodic part. Thus, a relatively strict "canon" performance is realized with the principal melodic part leading the additional melodic part.

In accordance with a further aspect of the invention, there is provided an apparatus for generating an additional musical part which comprises:

principal part providing means for providing a principal melodic part of a music piece;

chord progression providing means for providing a chord progression of the music piece;

control parameter generating means for generating control parameters (having different values) for each melodic line of an additional part to be added to the principal melodic part; and additional part generating means for generating the additional part having a plurality of melodic lines based on the principal melodic part, the chord progression and the control parameters.

With this arrangement, a plurality of different melodic lines (that constitute an additional musical part)

are formed by control parameters uniquely provided for the respective melodic lines.

In an embodiment, the control parameter generating means comprises pointer generating means for generating a pointer (one of the control parameters) for each melodic line of the additional part. The pointer locates a segment of the principal melodic part. The musical part generating means includes means for referencing the segment of the principal melodic part located by the pointer to determine current contents of each melodic line of the additional musical part.

In this arrangement, the segment pointers of the principal melodic part may locate different segments according to the melodic lines. Thus, different melodic lines are formed by different pointers. Using, for example, different segment rhythms of the principal melodic part as respective current rhythms of the additional melodic lines, the apparatus provides melodic lines having different rhythms from each other. In this case, each segment pointer serves as a control parameter for controlling note-ons and offs of a different one of the melodic lines of the additional musical part.

In another embodiment, the control parameter generating means includes pitch range parameter generating means for generating a different pitch range parameter for each melodic line of the additional musical part. The additional part generating means includes pitch determining means for determining a current pitch of each melodic line of the additional musical part by referencing the pitch range parameter for each melodic line.

In this arrangement, pitches of the additional melodic lines are controlled differently from one another to provide a diversified additional musical part.

The pitch range parameter may indicate a pitch interval from a (referenced) pitch of the segment of the principal melodic part pointed to by the pointer. Such a pitch interval may be represented by a distance of a chord member (used as a current pitch of an additional melodic line) from the referenced pitch. For example, for a pitch interval I (positive or negative number), a current pitch of the additional melodic line is defined by I-th member of a current chord counted from the referenced pitch of the principal melodic part in a pitch increasing (for positive) or decreasing (for negative) direction.

In accordance with a further aspect of the invention, there is provided an apparatus for generating a musical part which comprises:

first melodic part providing means for providing a first melodic part of a music piece;

chord progression providing means for providing a chord progression of the music piece; and second melodic part generating means for generating a second melodic part of the music piece as a musical part based on the first melodic part and the chord progression;

wherein the second melodic part generating means comprises:

pitch selecting rule defining means for defining a plurality of different pitch selecting rules;

rule selecting means for variably selecting a pitch selecting rule from the plurality of different pitch selecting rules; and pitch determining means for determining a current pitch of the second melodic part by referencing a current chord of the chord progression, a past pitch of the first melodic part and the pitch selecting rule selected by the rule selecting means, in which the current pitch of the second melodic part is represented by a member of the current chord that bears a pitch relationship with the past pitch of the first melodic part according to the pitch selecting rule.

This arrangement produces a second melodic part that depends on three different musical factors i.e., a given first melodic part, a chord progression and a selected pitch selecting rule. The rule defines a pitch relationship between a current pitch of the second melodic part and a referenced past pitch of the first melodic part by means of a current chord member. In this manner, the second melodic part varies with musical situations in various ways.

In accordance with an aspect of the invention, there is provided an apparatus for generating an additional musical part which comprises:

first melodic part providing means for providing a first melodic part of a music piece;

pitch set succession providing means for providing a succession of pitch sets available in a second melodic part of the music piece; and second melodic part generating means for generating the second melodic part based on the first melodic part and the succession of pitch sets;

wherein the second melodic part generating means comprises;

pitch selecting rule defining means for defining a plurality of different pitch selecting rules;

rule selecting means for selecting a rule from the plurality of different pitch selecting rules; and pitch determining means for determining a current pitch of the second melodic part by referencing a current pitch set of the succession of pitch sets, the rule selected by the rule selecting means and a reference pitch selected from a past pitch, a future pitch or a functional combination of pitches at different time points, of the first melodic part in which the current pitch of the second melodic part is represented by a member of the current pitch set that bears a pitch relationship with the reference pitch according to the selected rule.

An advantage of this arrangement is that a second (additional) melodic part varies in diversity as a function of musical situations of a given first melodic part, a succession of available pitch sets and a selected pitch selecting rule.

In accordance with a further aspect of the invention, there is provided an apparatus for generating a musical part which comprises:

principal part providing means for providing a principal melodic part; and musical part generating means for generating an additional musical part to be added to the principal melodic part;

in which the musical part generating means comprises;

reference time difference defining means for defining a reference time difference between the principal melodic part and the additional musical part;

adjusting time difference defining means for variably defining an adjusting time difference to be combined with the reference time difference; and determining means for determining current contents of the additional musical part by referencing a segment of the principal melodic part at a time point having a combined time difference of the reference time difference and the adjusting time difference from a current time.

With this arrangement, an additional melodic part is variably associated with a principal melodic part by a variable time difference given by the combination of a reference time difference and an adjusting time difference.

The invention further provides an apparatus for generating an additional musical part which comprises:

principal part providing means for providing a principal melodic part; and additional part generating means for generating an additional musical part to be added to the principal melodic part;

in which the additional part generating means comprises;

setting means for variably setting a time difference between the principal melodic part and the additional musical part;

pointer generating means for generating a pointer that points to a segment of the principal melodic part having the time difference from a current time; and determining means for determining current contents of the additional musical part by referencing the segment of the principal melodic part pointed to by the pointer.

With this arrangement a variable time difference between the principal part and the additional part is readily set by a simple operation of the setting means because it does not require settings of both a reference time difference and an adjusting time difference.

In accordance with a further aspect of the invention, there is provided an apparatus for generating an additional musical part which comprises:

principal part providing means for providing a principal melodic part;

rhythm quantizing means for quantizing a rhythm of the principal melodic part; and additional part generating means for generating an additional melodic part, the additional part generating means including rhythm means for generating a rhythm of the additional melodic part by using the quantized rhythm of the principal melodic part with a time difference.

This arrangement compensates for timing errors in the performance of a principal melodic part by quantizing a rhythm of the performed principal melodic part. Further, the quantized rhythm of the principal melodic part is used as a rhythm of an additional part with a time difference or shift. Thus, the resultant additional part will have a rhythm without timing errors in the performed principal melodic part.

BRIEF DESCRIPTION OF THE DRAWING

FIG. 2 shows main variables usable in the first embodiment;

FIG. 3 shows data formats usable in the first to third embodiments;

FIG. 4 shows a look-up table of chord members usable in the embodiments;

FIG. 15 shows main variables usable in the second embodiment;

FIG. 20 shows main variable usable in the third embodiment;

DETAILED DESCRIPTION OF THE INVENTION

The detailed description describes several preferred embodiments of the invention.

FIRST EMBODIMENT

In brief, the first embodiment of the invention is incorporated in an electronic musical instrument of a keyboard type. The apparatus of the first embodiment is arranged to receive performance data of a melody (principal part of a music piece, principal melodic part) from a melody keyboard. In this response and on a real time basis, the apparatus produces and outputs corresponding tones of the melody through a tone generator. Further, the apparatus receives data of a chord progression (a succession of chords), one chord at a time, from an accompaniment keyboard. Then, the apparatus generates, on a real time basis, performance data of an additional melodic part as a function of both the principal part (melody) and the chord progression, and similarly outputs tones of the additional part by means of the tone generator. The additional melodic part includes individual melodic lines as many as the preselected number. To control respective melodic lines, the apparatus produces control parameters for each melodic line of the additional part. The control parameters may have unique values for a different one of the additional melodic lines. The control parameter set of an additional melodic line comprises a pointer pointing to a (past) segment of the principal part that affects current contents of the additional melodic line. The rhythm of the principal part segment located by the pointer is used as a current rhythm of the additional melodic line. The rhythm refers to a succession of note or tone durations. The control parameter set further comprises a pitch range parameter of the additional melodic line. The pitch range parameter indicates a pitch interval of a current pitch of the additional melodic line from the pitch of the principal part segment pointed to by the pointer. A member of a current chord (from the chord progression) that accords with the pitch range parameter (pitch selecting rule) determines the current pitch of the additional melodic line. As a result, a pitch line component (a succession of pitches) of each additional melodic line varies depending on the principal part, the chord progression and the pitch range parameter.

Figure 1:
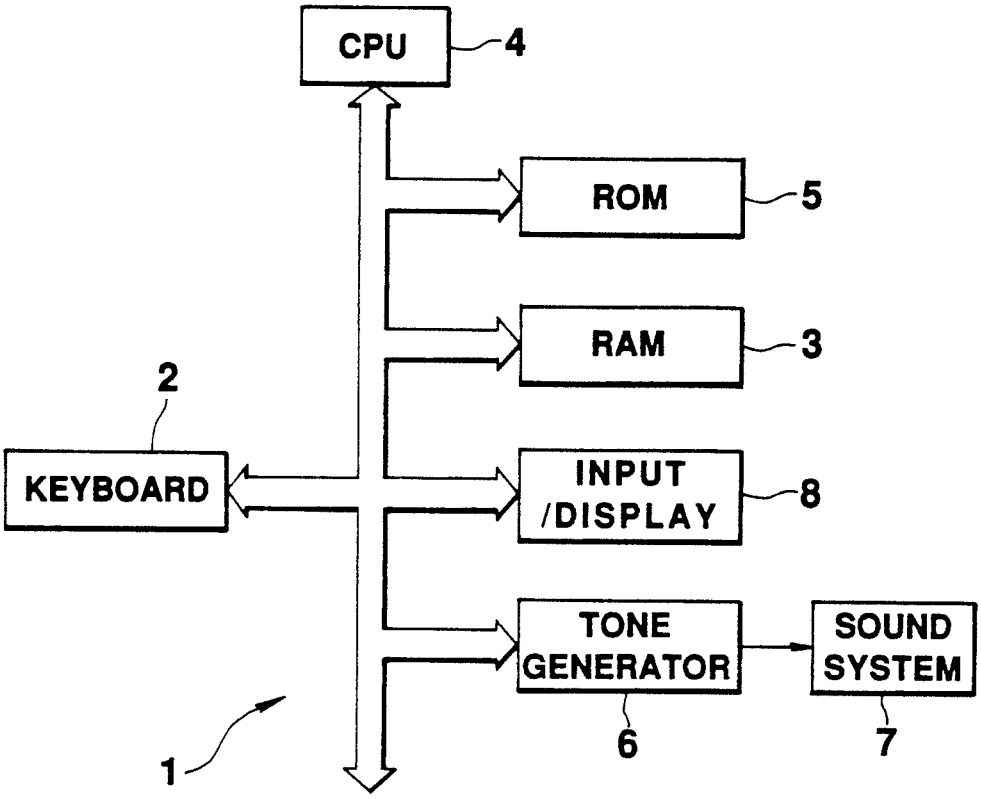
FIG. 1 is a block diagram of an overall arrangement of an electronic musical instrument with an additional melodic part generating function in accordance with the invention and for use in first through third embodiments thereof.

FIG. 1 shows an overall arrangement of a musical instrument 1 incorporating the first embodiment. Note, however that FIG. 1 arrangement can also be applied to second and third embodiments of the invention to be described later. A keyboard 2 is an example of means for inputting performance data of a melody (principal part) and data of a chord progression. To this end keyboard 2 may comprise a melody keyboard (for melody input) and an accompaniment keyboard (for chord progression input). In the alternative, a single keyboard may be divided into a right-hand section for a melody keyboard and a left-hand section for an accompaniment keyboard. RAM3 is used as a working memory of CPU4 and stores variables. ROM5 stores required programs and constants such as a look-up table of chord members. A tone Generator 6 electronically produces tones under the control of CPU1. The tone signals from the tone generator 6 are output (sounded) by a sound system 7. Input/Display 8 comprises an input unit having panel switches and a display unit such as a liquid crystal display (LCD) device. The panel switch includes selectors for selecting (setting) the total number of individual melodic lines contained in an additional melodic part. As will be described, the first embodiment automatically generates and plays an additional melodic part on a real time basis in addition to a principal part.

FIG. 2 shows main variables used by CPU4 in the operation of the first embodiment. A variable T indicates a current time. A variable $T_M$ is a pointer pointing to a segment of a principal part that affects current contents of an additional (subsidiary) part. F is a flag of a direction of a pitch distance (interval) of a current pitch of the additional part from a referenced pitch of the principal part segment at $T_M$. The current pitch (current additional pitch) may be either higher or lower than the referenced pitch (past principal pitch) depending the flag F. A variable L indicates a magnitude of the pitch distance between the current additional pitch and the past principal pitch; the pitch distance is a count of chord members measured from the past or referenced principal pitch. The combination of F and L defines a pitch range parameter of the additional melodic part. For example, for $F=-1$, $L=2$, the current additional pitch is given by a member of a current chord appeared for the second time when looking downward from the referenced principal pitch. A variable CR indicates a root of a current chord. A variable CT represents a type of the current chord. The current chord is specified by CR and CT. Each time a new chord is supplied from the accompaniment keyboard, the contents of CR and CT are updated to the newly supplied chord. EL[] indicates a current pitch of each additional melodic line. An array MD[] stores performance data of the principal part supplied from the melody keyboard. CKT[] represents a look-up table of chord members. An example of CKT[] is shown in FIG. 4. A variable CLK indicates musical time resolutions per bar. LINE indicates a number of an additional melodic line being generated. A variable MAXLINE represents the total line number included in the additional melodic part. MDN indicates the size of the melody array MD[].

FIG. 2 further illustrates data types of respective variables. T, $T_M$, F, L, CLK, LINE and MAXLINE are each represented by an integer. CT is of a chord type while CR, EL[], MD[] and CKT[] are each of a melody type. The meaning of the "chord type" and "melody type" is defined in FIG. 3. A melody type variable indicates an off state (absence of a note ) with a number "−1". The melody type variable indicates a pitch C2 with "0", and indicates respective pitches C#2, D2, D#2 and so on with successively incremented numbers. The melody array MD[] is a melody type variable. An element number (memory address) of MD[] corresponds to a time point. The element itself stores a principal (melody) pitch (if any). Thus, the melody array MD[] indirectly contains rhythm information on the principal part as well as the pitch information. As will be described, in a routine of "Play Subsidiary Part", CPU4 takes a note-off action when a principal pitch element MD[$T_M$] pointed to by $T_M$ changes to an off state. CPU4 performs a note-on process when MD[$T_M$] indicates an actual pitch. As a result, the additional part is given a rhythm that follows the rhythm of the principal part with a time lag.

The variables $T_M$, F and L define control parameters of an additional melodic line. It should be noted that CPU4 generates these parameters for each additional melodic line of the additional part: the values of the control parameters (e.g., $T_M$) may be different according to additional melodic lines, resulting in different additional melodic lines.

A chord type variable indicates respective chord types with numbers; for example "0" for major, "1" for minor, "2" for minor seventh, "3" for major seventh and so on. The chord member look-up table in FIG. 4 returns chord members when looked up by an argument including the chord type variable CT. In FIG. 4, each chord (type) is allocated four successive memory locations to store up to four members of a chord. For a tried chord having three members, its fourth storage location is masked with "−1" or off. The major chord is illustrated to have chord members of "0", "4" and "7". The "0" indicates a root (first member). The "4" indicates a (second) member major 3rd degree above the root. The "7" indicates a (third) member perfect 5th degree above the root. The actual pitches of the chord members are specified when the pitch of the root is given by CR.

Figure 5:
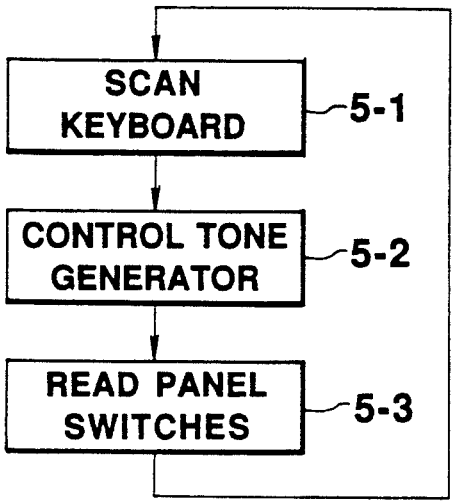
FIG. 5 is a flow chart of a main routine in the first and second embodiments.

FIG. 5 shows a flow chart of the main routine in the first embodiment; the same flow may also apply to the main routine in the second embodiment which will be taken up later.

Figure 6:
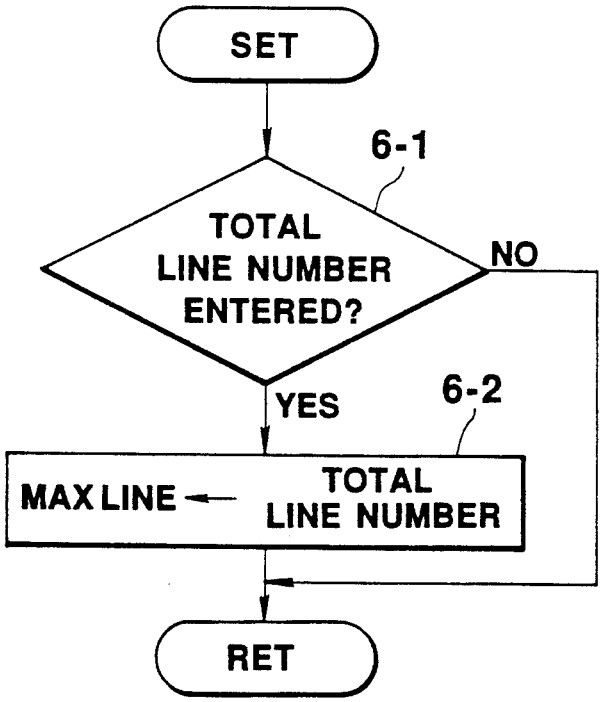
FIG. 6 is a flow chart of setting a total line number of an additional melodic part in the first embodiment.

The main routine comprises subroutines of Scan Keyboard 5-1, Control Tone Generator 5-2 and Read Panel Switches 5-3. Scan Keyboard 5-1 detects key information from the keyboard 2. Control Tone Generator subroutine 5-2 controls the tone generator 6 for the principal part melody from the melody keyboard to play (sound tones of) the principal part. Generating and playing of the additional part is carried out in the time interrupt routine in FIG. 7. Read Panel Switches subroutine 5-3 reads panel switches in the input/display 8. This routine 5-3 includes setting MAXLINE in response to the selected total line number input, as shown in 6-1 and 6-2 in FIG. 6.

Figure 7:
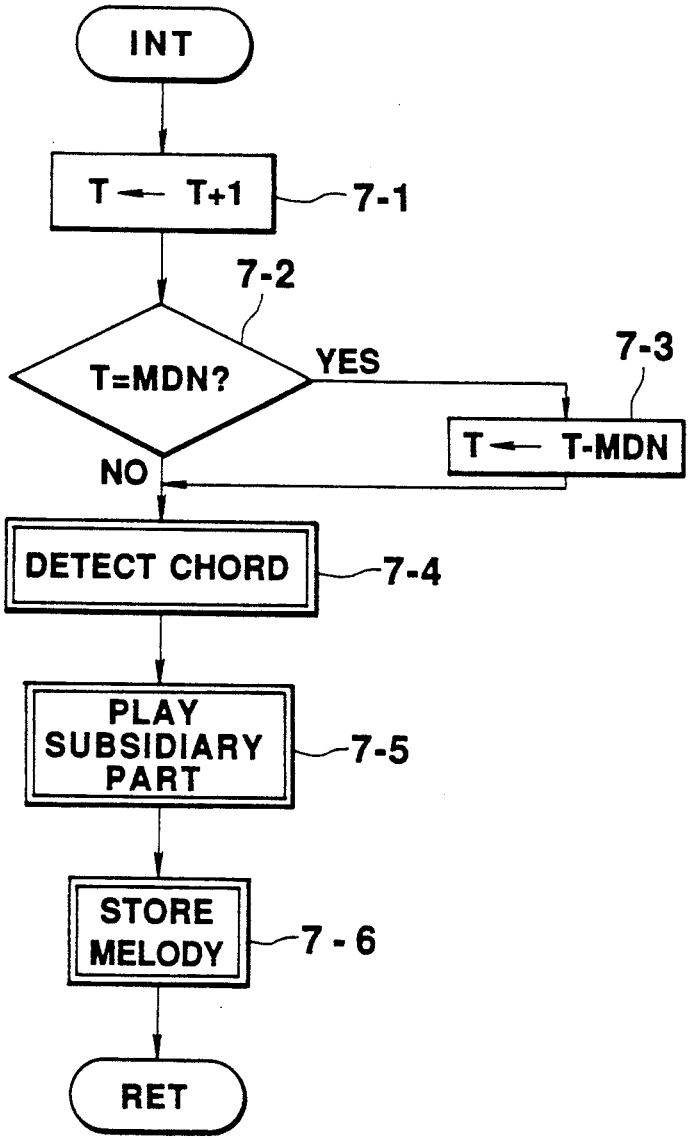
FIG. 7 is a flow chart of a time interrupt routine in the first embodiment.

The time interrupt routine of FIG. 7 is periodically carried out per musical time resolutions at a rate of, for example, 96 times a bar. Block 7-1 increments the current time T. If T has reached the size of the melody array MDN (e.g., 96) in 7-2, T is subtracted from MDN so that the resultant T will point to the first element of the melody array MD[0] (7-3).

Then Detect Chord process 7-4, Play Subsidiary Part process 7-5 and Store Melody process 7-6 are performed.

Figure 8:
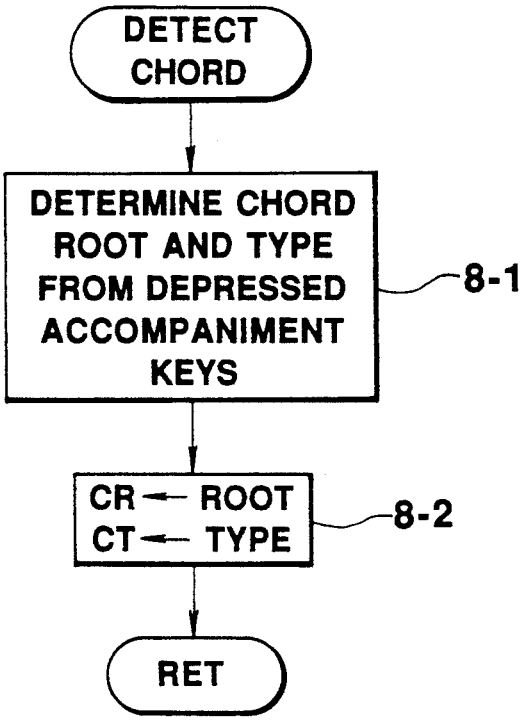
FIG. 8 is a flow chart of a Detect Chord routine in the embodiments.

FIG. 8 shows details of the Detect Chord routine 7-4. As shown, block 8-1 determines a (current) chord type and root from depressed accompaniment keys. Block 8-2 sets CR and CT to the detected root and type, respectively.

Figure 10:
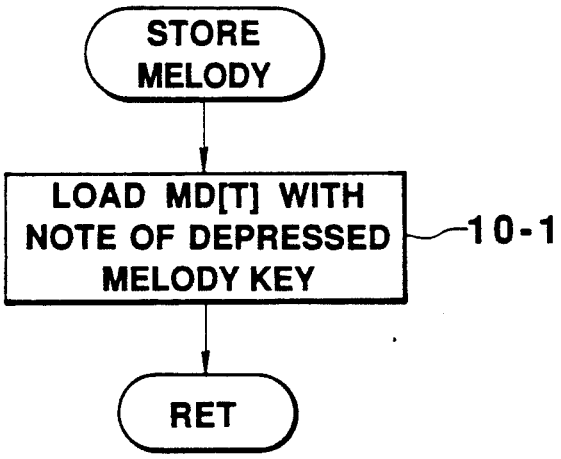
FIG. 10 is a flow chart of Store Melody routine in the first and second embodiments.

As shown in FIG. 10, Store Melody process 7-6 loads a note (pitch) of a depressed melody key into MD[T] which is an element of MD[] pointed to by the current time T(10-1).

Figure 9:
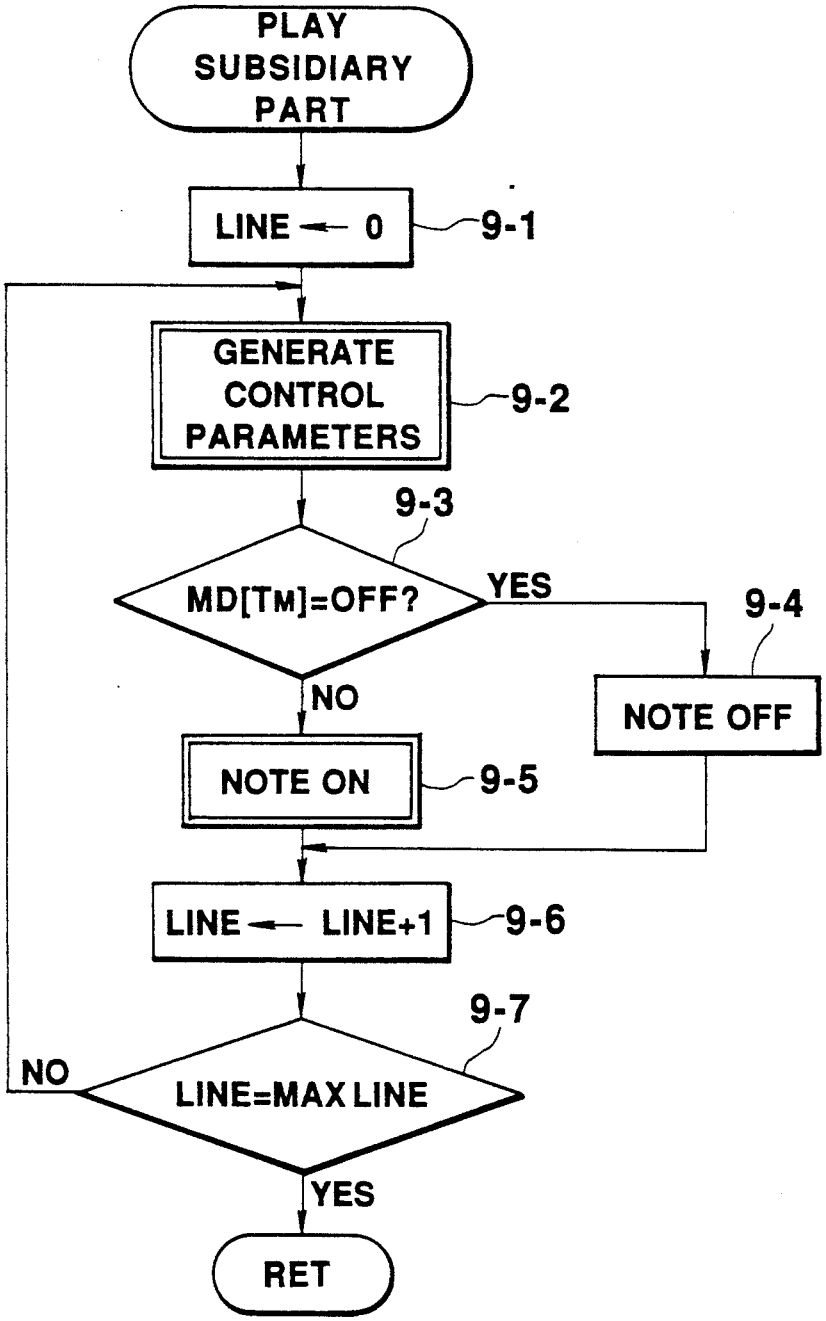
FIG. 9 is a flow chart of a Play Subsidiary Part routine in the first embodiment.

FIG. 9 shows a flow chart of Play Subsidiary routine 9-6. Block 9-1 initializes the additional line number LINE to "0". Using LINE as an argument, block 9-2 generates control parameters $T_M$, L and F for an additional line with the number LINE. The next block 9-3 sees if $T_M$-th melody array element MD[$T_M$] indicates an off state. If MD[$T_M$]=off, a Note-off routine 9-4 is executed for the additional line. Otherwise, a Note-on routine 9-5 is executed. Then block 9-6 increments the line number LINE. If the line number is less than MAXLINE (the total line number of the additional part), Play Subsidiary part procedure goes back to Generate Control Parameters 9-2 to generate and play the next additional line. If LINE has reached the total line number, Play Subsidiary Part routine terminates.

Figure 13:
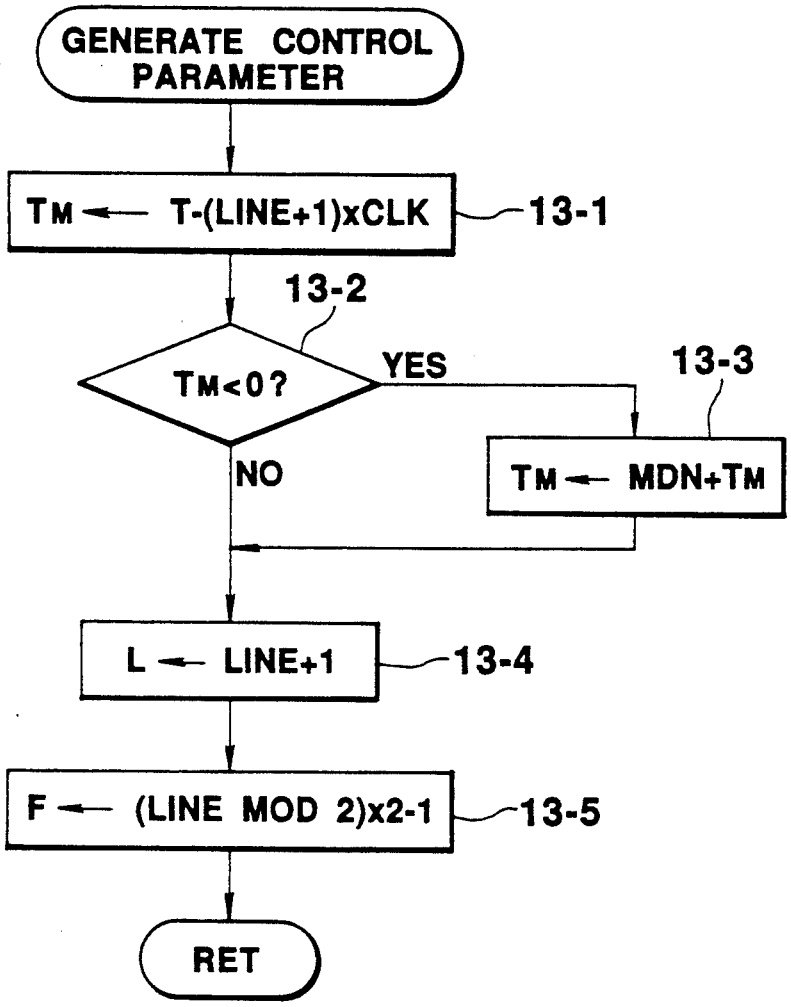
FIG. 13 is a flow chart of a Generate Control Parameter routine in the first embodiment.

FIG. 13 shows details of Generate Control Parameters 9-2. The purpose of this process is to generate control parameters for an additional melodic line with a line number of LINE. Blocks 13-1 to 13-3 calculates a pointer $T_M$ to a segment of the principal part (an element of the melody array MD[]) which will be referenced to determine current contents of the additional line. More specifically, block 13-1 calculates T−(LINE+1)xCLK and store the results into $T_M$. If $T_M<0$ (13-2) block 13-3 adds the melody array size MDN to $T_M$. In this example, for the first additional line (LINE=0), the pointer $T_M$ points to a principal part segment one bar before the current time; for the second line, $T_M$ points to a two bar prior principal part segments, and so on. The next block 13-4 sets L to LINE+1. Block 13-5 calculates (LINE mode 2)×2−1 and stores the results into F.

In this manner, unique control parameters are automatically generated for respective additional melodic lines.

Figure 11:
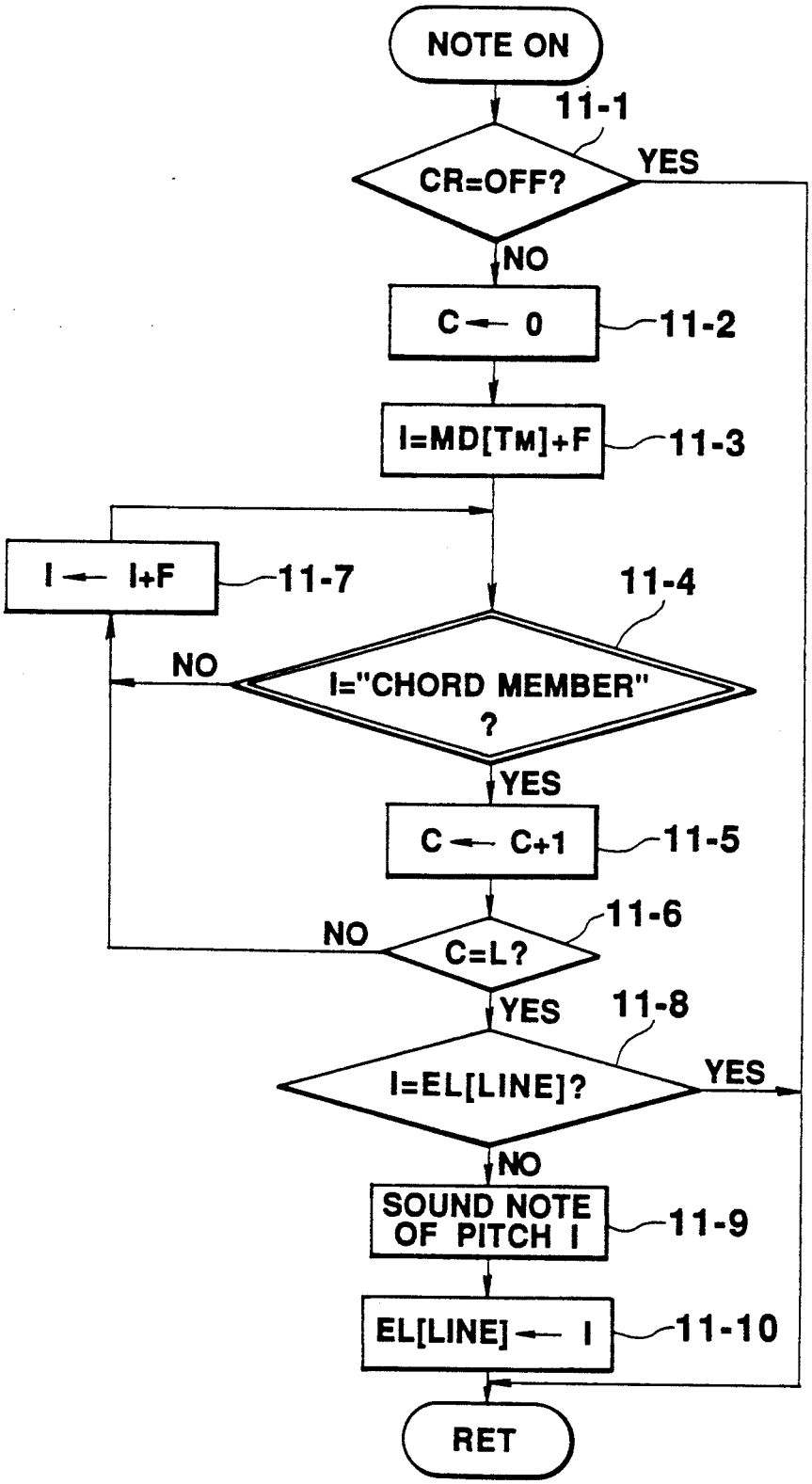
FIG. 11 is a flow chart of a Note-on routine in the first embodiment.

FIG. 11 shows details of Note-on routine 9-5. Block 11-1 sees if a current chord exists. If there is no current chord (CR=OFF), Note-on routine terminates without any further operation. If there is a current chord, Note-on routine determines a current pitch of the additional line of interest from the pointer $T_M$, higher/lower flag F, pitch distance parameter L, (member) pitch contents of the current chord and a principal part segment at $T_M$. More specifically, block 11-2 initializes a count C of chord members found in the vertical pitch search from the principal part segment pitch (referenced principal pitch). Block 11-3 initializes a pitch pointer I to a pitch a semitone below (if F=−1) or above (for F=1) the referenced principal pitch MD[$T_M$] by setting I equal to MD[$T_M$]+F. Block 11-4 sees if pitch I is a member of the current chord. If not, Note-on routine moves to block 11-7 to increment or decrement I by a semitone according to F and repeats I=chord member? check 11-4. If I is a chord member, block 11-5 increments the chord member count C. Then, block 11-6 sees if the count C matches the pitch distance parameter L. If not matched, block 11-7 changes I by F and block 11-4 checks again if I is a member of the current chord. If the count C has reached a point of the pitch distance L, the pitch I is a current chord member appeared for L-th time when searching down or up (in a direction of F) from the referenced principal pitch MD[$T_M$] i.e., a pitch of the principal part at $T_M$. This pitch I specifies the current pitch of the additional line of interest. Then, block 11-8 checks to see if the current pitch I is the same as the previous pitch EL(LINE). If the same, no operation is required because a note of pitch I is currently lasting and sounding. If not, note-on block 11-9 sounds a tone of pitch I of the additional line. Block 11-10 saves I into EL(LINE) in preparation for the pitch comparison 11-8 at the next pass of Note-on routine.

Figure 12:
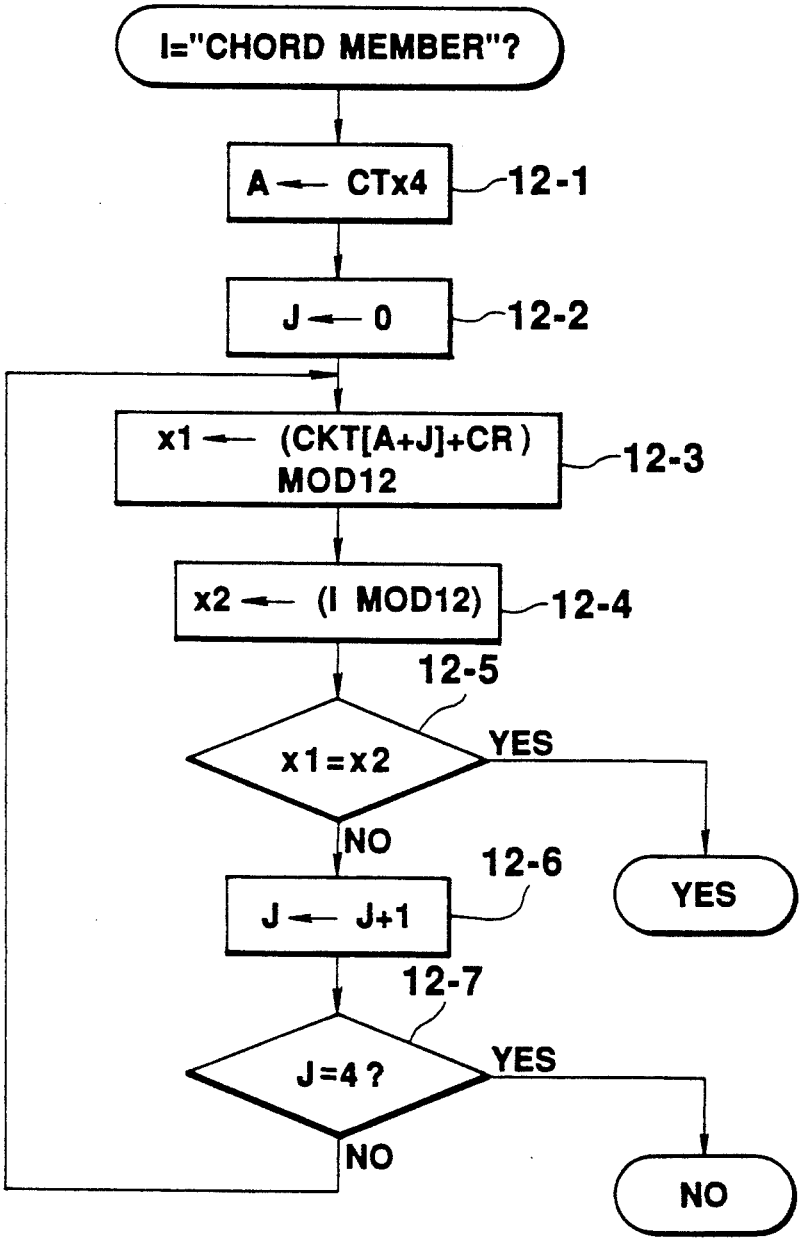
FIG. 12 is a flow chart of a Chord Member? routine in the embodiments.

FIG. 12 shows details of I=chord member? routine 11-4. As stated, chord member look-up table (FIG. 4) assigns four successive memory locations to each chord. Thus, an address pointer A is initialized to a location in the chord member look-up table where the first member of a current chord type is stored (12-1). A member number J is initialized to "0" (12-2). In the loop 12-3 to 12-7, for J=0 to 3, chord member? routine gets J-th chord member pitch class X1 (one of C to B) of the current chord by calculating (CKT[A+J]+CR) mod 12 (12-3), where CKT[A+J] indicates J-th chord member of the current chord type looked-up from the chord member table and CR indicates the current chord root pitch. Further, chord member? routine gets I's pitch class X2 (12-4). If the pitch class of I matches that of J-th chord member (12-5), I=Chord member? routine returns YES. If not matched, J is incremented (12-6). If J has reached 4 (12-7), the routine returns NO.

In this manner, the first embodiment generates and plays individual melodic lines of the additional part as many as MAXLINE. For MAXLINE=3, the first line of the additional part is given a rhythm that repeats the rhythm of the principal part with a time lag of one bar. The rhythm of the second line follows the principal part rhythm with another time delay of two bars. The third line rhythm is delayed from the principal part rhythm by three bars. The first additional line is provided with a pitch wave of an arpeggio controlled with T=−1 and L=1. Each pitch of the first additional line is given by a pitch of a chord member then existing and found first when looking downward from a one-bar past principal part pitch. With F−1, L=2, the second line is given a pitch that is specified by a pitch of a chord member existing at that time and found for the second time when looking upward from a two-bar past principal part pitch. Under F=−1, L=3, the third line is given a pitch of a chord member then existing and found for the third time when searching downward from a three-bar past principal part pitch.

In this manner, the first embodiment generates a diversified additional musical part formed by a plurality of different individual melodic lines each as a different function of the principal part.

MODIFICATIONS OF THE FIRST EMBODIMENT

The first embodiment of the invention has been described. Various modifications will be obvious to those skilled in the art.

Figure 14:
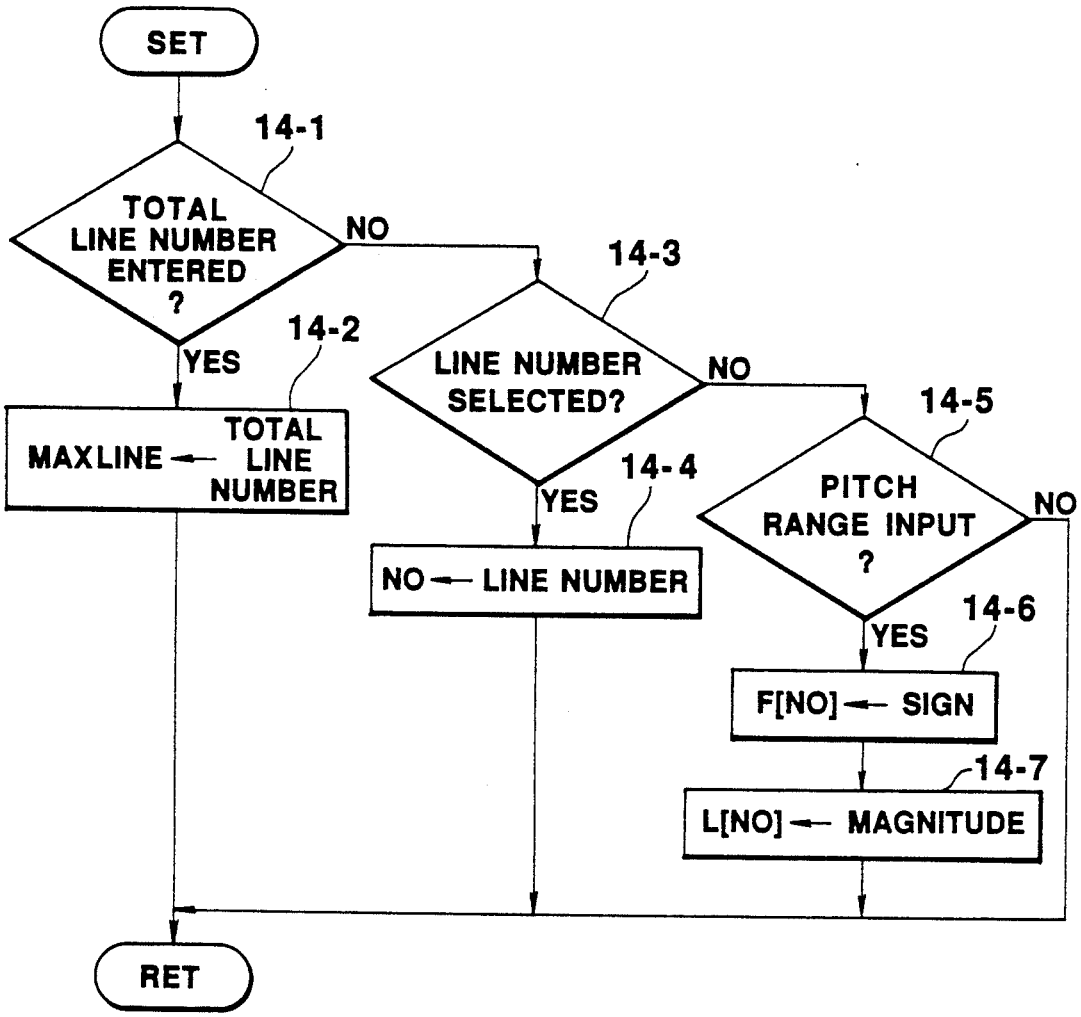
FIG. 14 is a flow chart of a Set routine usable in a modification of the first embodiment.

The first embodiment uses the line number LINE as an argument to automatically generate control parameters unique for respective additional melodic lines. In a modification, at least part of the control parameters are obtained from a user's input by the input/display 8. Such modification is shown in Set routine of FIG. 14. Blocks 14-1 and 14-2 correspond to blocks 6-1 and 6-2 in FIG. 6 and are to set the total line number of the additional melodic part in the same manner. Block 14-3 sees if a line number has been selected by a panel switch in the input/display 8. If selected, that line number is stored in NO register (14-4). Block 14-5 sees if a pitch range has been input by a panel switch. If so, the sign of the pitch range input is stored into a register I[NO] pointed to by the line number NO(14-6), and the magnitude of the pitch renge is stored into a register L[NO] pointed to by NO(14-7). If desired, F[NO] may store an integer and L[NO] may store a natural number. Because I[] and L[] are obtained in this routine, the blocks 13-4 and 13-5 in Generate Control Parameters routine of FIG. 13 will be omitted. F[LINE] substitutes for F in 11-3 and 11-7 in Note-on procedure of FIG. 11. L[LINE] substitutes for L in 11-6. With this arrangement, a user may designate the desired pitch range for each melodic line of the additional part.

Data of principal part (melody) and chord progression may be provided in advance. This is achieved, for example, by storing such data from a playing input such as a keyboard before generating an additional part. In such an environment, the additional part generating apparatus may reference a future segment of the principal part in place of a past segment to generate an additional part.

Another modification may be arranged to determine current contents of the additional part as a function of a plurality of segments of the principal part and/or other part at a plurality of different time points. For example, using a pitch MD[T1]] of the principal part at a first time point T1 with a predetermined time difference from a current time, and another pitch MD[T2] of the principal part at a second time point T2 with another predetermined time difference from the current time, the modified apparatus produces a pitch MD that affects a current pitch of an additional melodic part as a linear combination of MD[T1] and MD[T2].

$$MD = W1 \times MD[T1] + W2 \times MD[T2]$$

where W1 and W2 indicate weighting factors.

The affecting pitch MD may substitutes for the referenced pitch of the principal part at a one-bar past time used in the first embodiment to determine the current pitch of the additional part. The weighting factors may be either a constant or a variable obtained from combining a fixed value with a relatively small random component. In another version, there is provided a weight pattern memory storing a weight pattern of weighting factors that varies with a musical time. To create a current additional pitch, data of weighting factors available at the current time are read out from the memory. More than two pitches of the principal part may be combined in a linear function to obtain a reference pitch for the additional part.

The time difference between the current additional pitch and the affecting principal pitch may be changed as music proceeds (e.g., according to phrases).

In the first embodiment, the additional part is a melodic part having varying pitches. However, the rhythm control of the invention may also apply to an additional part of a pure rhythmic character such as a percussion part.

In the first embodiment, all pitch elements of the additional part are chord members (chord tones) selected from the chord progression. However, the invention may also apply to an additionasl part with a pitch succession including both chord (harmonic) tones and non-chord (nonharmonic) tones.

To achieve this, an additional part generating apparatus may include a principal part analyzer of the type as disclosed in U.S. patent application Ser. No. 288,001 filed Dec. 20, 1988, assigned to the same assignee as the present application, and incorporated herein for reference. The analyzer classifies pitches of the principal part into various harmonic and nonharmonic tones according to stored melody knowledge. Thus, the analysis results in an array of harmonic tones (arpeggio pattern) and an array of nonharmonic tones (nonharmonic patten). Then, the apparatus uses, with a time difference, the arpeggio pattern in the principal part to generate a current arpeggio pattern of an additional part in a manner similar to the first embodiment. To add nonharmonic tones to the current arpeggio pattern of the additional part, the apparatus may use the array of nonharmonic tones extracted. To this end, each element of the nonharmonic tone array (nonharmonic tone identifier) is tested to see whether such element can be placed in the additional part at a corresponding horizontal (time) point before, after a chord tone or between chord tones: This test is made according to the stored knowledge; pitch candidates are vertically scanned to search for a pitch having the same nonharmonic tone identifier as the associated element of the nonharmonic tone array. If such a pitch is found, it is placed in the additional part.

With this arrangement, both harmonic and nonharmonic pitch elements of the additional part are affected by the principal part with a time difference or shift.

SECOND EMBODIMENT

The description with now take up the second embodiment of the invention. Note that FIGS. 1, 3–5, 8, 10 and 12 already referred to in connection with the first embodiment are also applied in the second embodiment.

In brief, the second embodiment is incorporated in an electronic musical instrument of a keyboard type (see FIG. 1). The instrument is arranged to receive performance data of a melody (principal part) from a melody keyboard. The instrument responds with tones of the principal part. Further, the instrument receives data of a chord progression from an accompaniment keyboard. Then, the second embodiment generates data of an additional musical part as a function of the principal part and the chord progression. The rhythm (succession of tone durations) of the principal part is used with a time difference to generate a rhythm of the additional part. The time difference between the principal and additional parts is specified by a combination of a reference time difference (lag time reference) and an adjusting time difference (phase control component). A user may variably select an amount of the reference time difference in a unit of bar, and an amount of the adjusting time difference by a step of a musical time resolution (CLK) of the system. The succession of pitches in the principal part is also referenced to determine a pitch succession of the additional part. For example, a current chord member closest to a past pitch in the principal part forms a current pitch in the additional part. The generated additional part is played (sounded) through a tone generator. As a result, a "canon" music is obtained by the principal and additional parts with a time difference between them.

The second embodiment may be incorporated in the musical instrument of FIG. 1. The keyboard 2 comprises a melody keyboard for inputting performance data of a principal (melodic) part and an accompaniment keyboard for inputting data of a chord progression, one chord at a time. RAM3 stores various variables and is used as a working memory of CPU4. ROM5 stores the required program and permanent data such as a chord member look-up table. Under the control of CPU4, the tone generator 6 generates tone signals which are sounded through the sound system 7. For the second embodiment the input/display 8 includes panel switches for setting a time difference between the principal and additional part.

FIG. 15 shows main variables used by CPU4 of the second embodiment. A variable T indicates a current time and points to a current element of a melody array. A variable BAR indicates a reference time difference (lag time reference) between a principal part and an additional part. D variable indicates an adjusting time difference (phase control component of the net difference) between principal and additional parts. A variable CLK represents a musical time resolution per bar (e.g., 96/bar). A variable $T_M$ points to an element of the melody (principal part) array on which current contents of the additional part depend. CR variable indicates a current chord root pitch. CT variable indicates a current chord type. The combination of CR and CT represents the current chord. The current chord is updated each time a new chord is input from the accompaniment keyboard. EL variable indicates a current pitch of the additional part. MD[] is the melody (principal part) array that stores performance data of the principal part. The size of the melody array MD[] is indicated by MDN. CKT[] represents a chord member look-up table as illustrated in FIG. 4.

Each of T, BAR, D, CLK, $T_M$ and MDN is a variable of integer type. CT is a chord type variable the meaning of which is defined in FIG. 3 already referred to in the first embodiment. CR, ET, MD[] and CKT[] belong to a melody type the meaning of which is also shown in FIG. 3.

The net time difference between the principal and additional parts is specified by combining the lag time reference BAR with the phase control component D. The values of BAR and D are user-programmable.

The main routine of the second embodiment operates according to the flow chart of FIG. 5 which has been taken up in the description of the main routine of the first embodiment. Note, however that Read Panel Switch subroutine 5-3 of the second embodiment includes a Set procedure such as shown in FIG. 16 for variably setting the time difference between the principal and additional parts.

Figure 16:
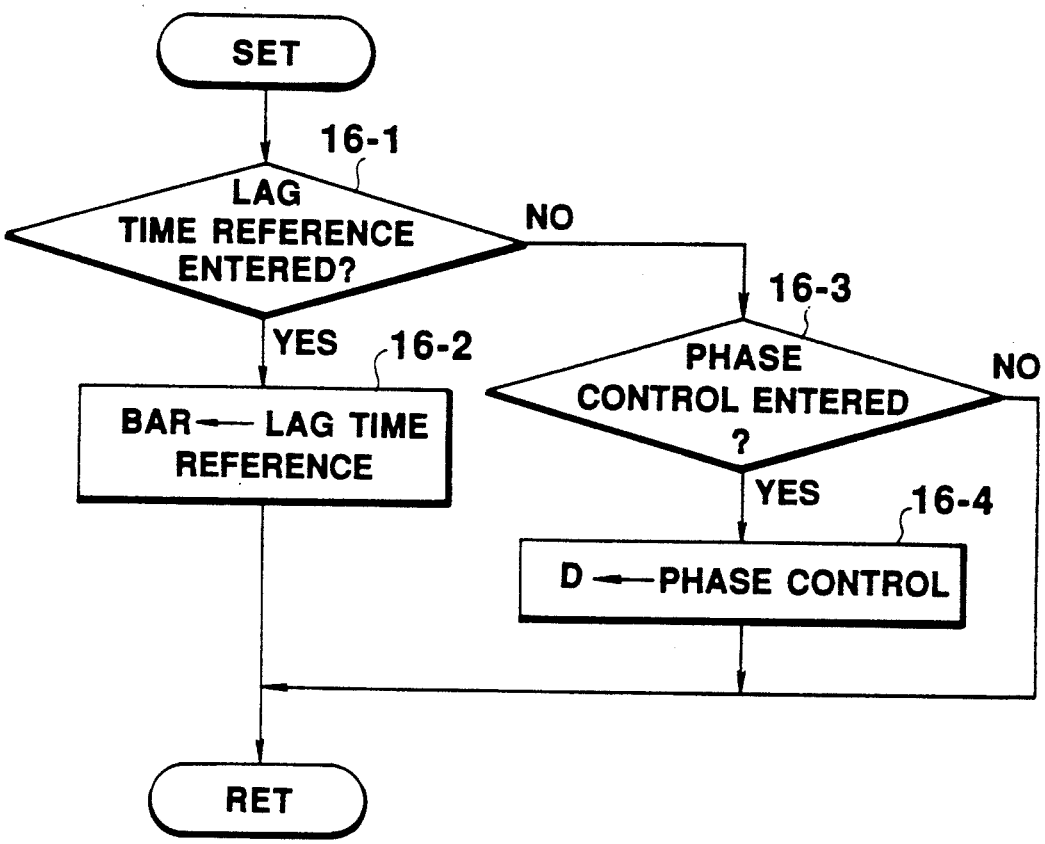
FIG. 16 is a flow chart of setting a time difference between principal and subsidiary parts in the second embodiment.

In the Set procedure of FIG. 16, if a lag time reference is entered from a panel switch (16-1), it is stored into BAR register (16-2). If a phase control component is entered from a panel switch (16-3), it is stored into D register (16-4).

Figure 17:
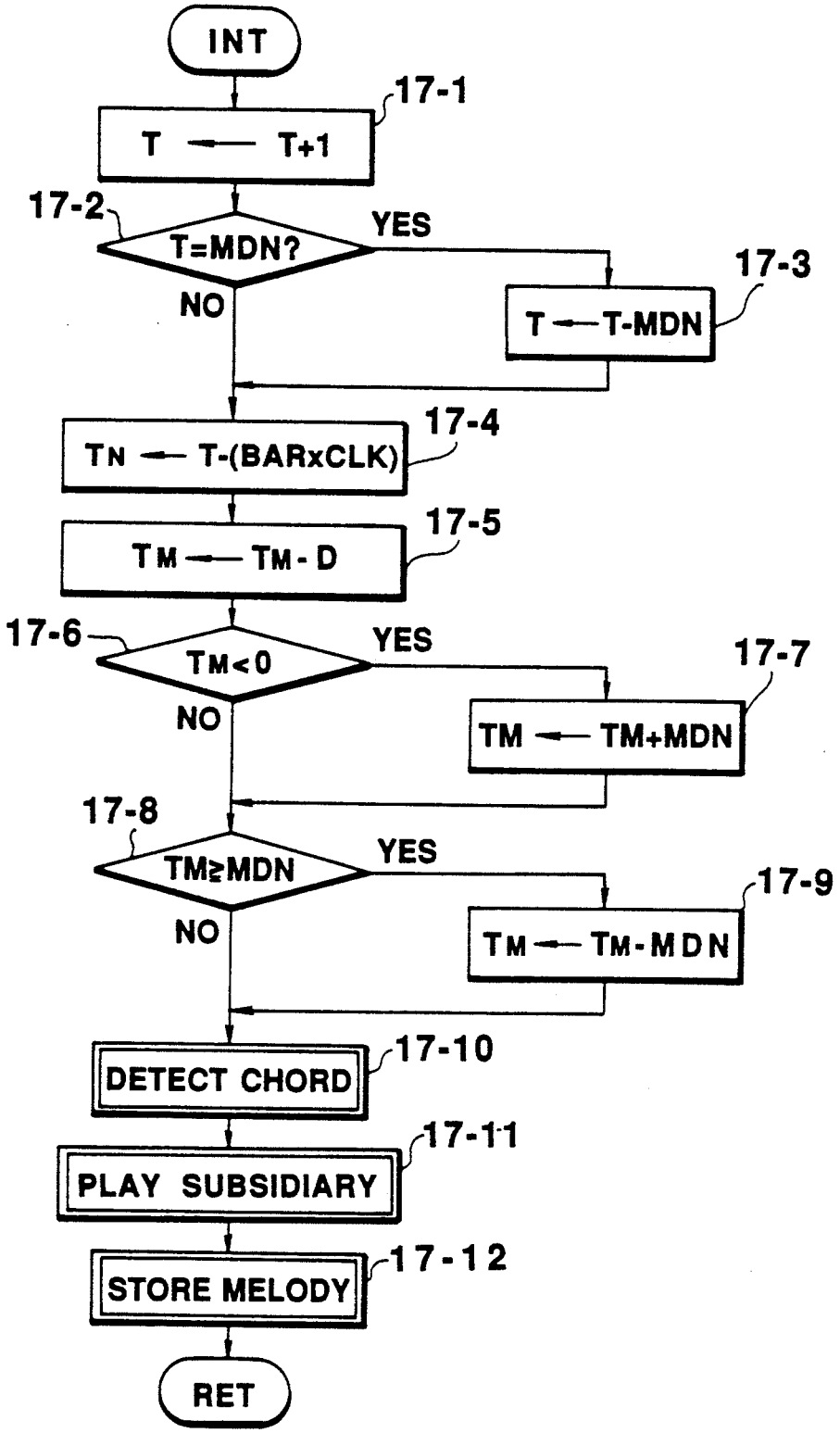
FIG. 17 is a flow chart of a time interrupt routine in the second embodiment.

FIG. 17 shows a flow chart of a time interrupt routine periodically executed by CPU4 of the second embodiment at a rate of say, 96 times a bar corresponding to the musical time resolution. Block 17-1 increments the current time T. If T has reached the melody array size MDN (17-2), MDN is subtracted from T so that T points to the first element of the melody array MD[]. Blocks 17-4 to 17-9 update pointer $T_M$ for the additional part. Specifically, using the current time T, the time lag reference BAR and the bar time resolution CLK, the block 17-4 calculates $T-(BAR \times CLK)$ and loads the results into $T_M$. $T_M$ now indicates a past time point of BAR measures before the current time T. Then, the block 17-5 subtracts the phase control component D from $T_M$ to adjust the time difference. The blocks 17-6 to 17-9 normalize the value of $T_M$ in the range of 0 to $(MDN-1)$ to assure that $T_M$ points to an element of the melody array MD[]. If D is zero, $T_M$ indicates a time point just a whole number (BAR) of bars before the current time. If D is either positive or negative, this shifts a time point of $T_M$ by D's value.

Then, the time interrupt routine performs Detect Chord procedure 17-10, Play Subsidiary procedure 17-11 and Store Melody procedure 17-12.

Detect Chord procedure 17-10 detects a current chord from the accompaniment keyboard in the same manner as in the first embodiment according to the flowchart of FIG. 8.

Also, Store Melody subroutine 17-12 stores a current melody note from the melody keyboard in the same manner as in the first embodiment according to the flowchart of FIG. 10.

Figure 18:
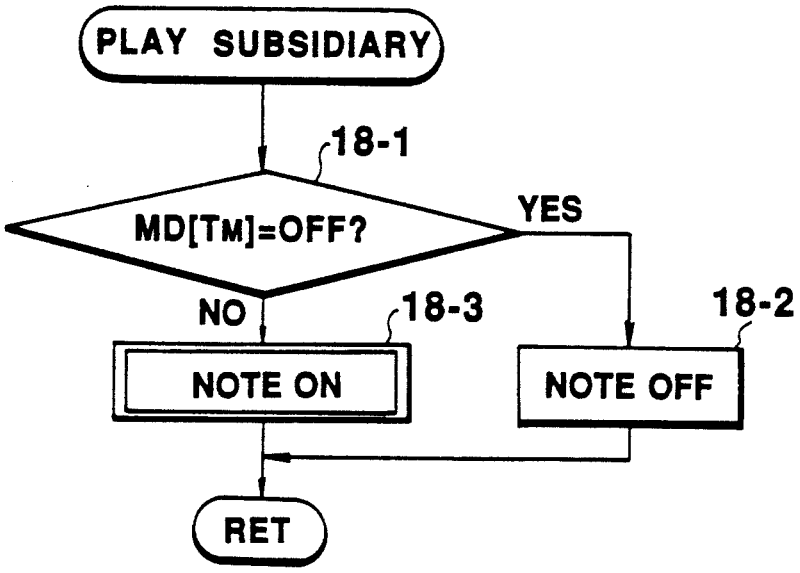
FIG. 18 is a flow chart of a Play Subsidiary routine in the second embodiment.

Play Subsidiary procedure 17-11 is carried out according to the flowchart of FIG. 18 to generate and play an additional musical part.

In FIG. 18, if the melody array element $MD[T_M]$ pointed to by $T_M$ time pointer indicates an off state (18-1), Note-off procedure 18-2 is executed for the additional part. If $MD[T_M]$ indicates a pitch, Note-on procedure 18-3 is executed. As a result, the additional part is given a rhythm which repeats the principal part rhythm with the time lag indicated by $(T-T_M)$. The value of $(T-T_M)$ corresponds to the combination of the time lag reference BAR (indicative of a delayed bar number) and the phase control component D. With $D=0$, the additional part rhythm is delayed from the principal part by just a whole number of bars. If D is non-zero, the additional part rhythm is shift correspondingly.

A principal part may have a melodic phrase the duration of which is unequal to the length a bar or bars. In such case, selecting the desired value of D, the second embodiment can provide an additional part that rhythmically matches the principal part; the phrase repeats at the desired musical time intervals. For a monotonous principal part, the phase control component D may serve to impart a variety to a polypholic music formed by the principal and additional parts.

Figure 19:
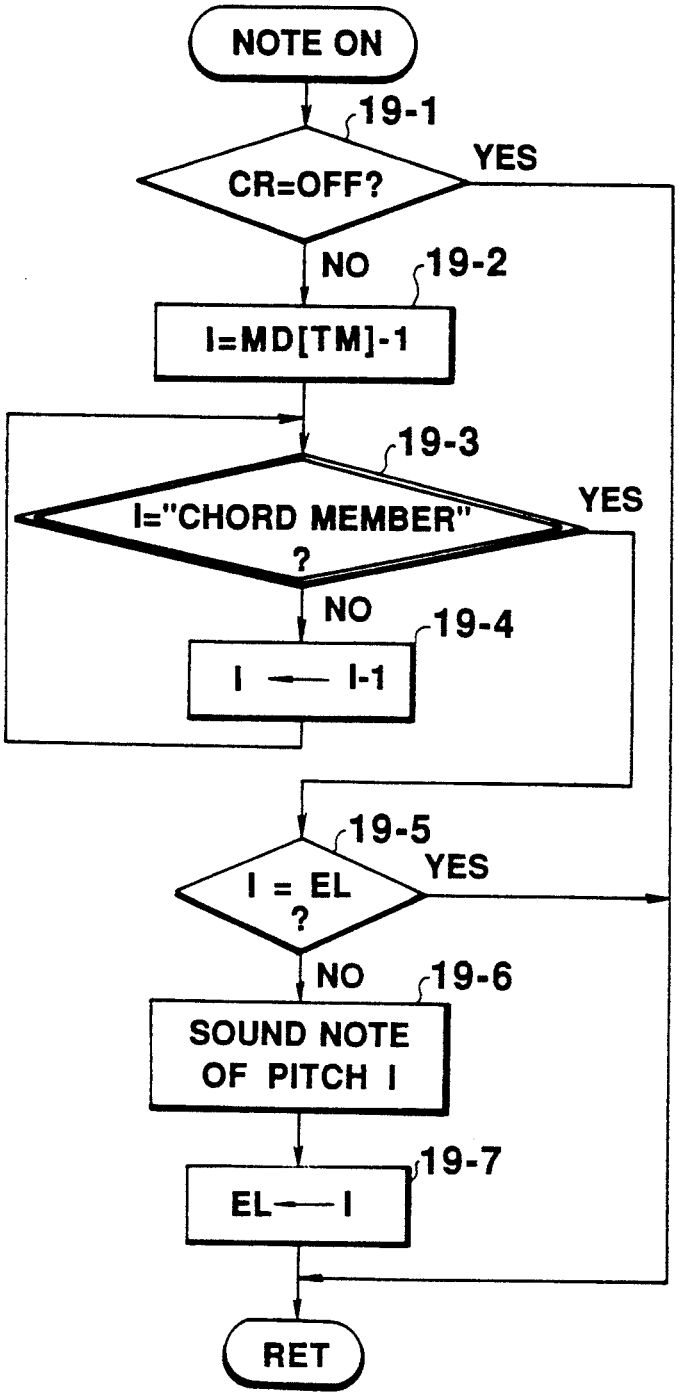
FIG. 19 is a flow chart of a Note-on routine in the second embodiment.

FIG. 19 shows a detailed flow chart of Note-on routine 18-3. If there is no current chord with CR=off (19-1), Note-on routine directly terminates. If a current chord exists, blocks 19-2 to 19-4 search for a current pitch of the additional part (current additional pitch) that is a current chord member pitch closest to and below the pitch element $MD[T_M]$ of the principal part. Note that $MD[T_M]$ indicates a past pitch of the principal part at $T_M$ with the time difference $(T-T_M)$ from the current time T. The current additional pitch found is stored into I register.

Block 19-5 checks to see if the current additional pitch I is the same as the immediately preceding pitch EL. If so, the Note-on routine terminates because a tone of pitch I is currently lasting. If the current additional pitch I is a new or different pitch from the preceding pitch, a tone of pitch I is sounded (19-7) and the pitch data I is saved into EL (19-7).

In this manner, the second embodiment automatically generates and plays, on a real-time basis, an additional musical part while a principal part and a chord progression are being supplied from the keyboard. The additional part follows the principal part with a variably selected time delay to provide a "canon" music. The additional part is Given a succession of pitches each determined by a function of a current chord from the chord progression and a pitch element of the principal part at a past time point specified by the variable time delay data of BAR and D.

MODIFICATIONS OF THE SECOND EMBODIMENT

The second embodiment has been described. Various modifications will be readily implemented by a person having ordinary skill in the art in accordance with the teachings of the invention.

For example, the additional melodic part generated in the second embodiment is made of a single melodic line with a single succession of pitches. It is obvious to modify the arrangement so as to generate a plurality of different melodic lines for the additional part. Such modification will provide a polyphonic music with an increased diversity.

In the second embodiment, the time lag reference BAR and the phase control component K are separately set by a user to provide a variable net time difference between the principal and additional parts. The net time difference is obtained by combining BAR and D. In the alternative, a single user-programmable parameter may be used to set the net time difference.

The invention may also apply to an automatic rhythm machine which generates an additional musical part of pure rhythmic character without a succession of variable pitches.

THIRD EMBODIMENT

The description now turns to the third embodiment of the invention. Note that FIGS. 1, 3, 4, 8 and 12 which were referred to in the description of the first embodiment may also apply to the third embodiment.

In brief, the third embodiment is incorporated in an electronic musical instrument of a keyboard type such as the one shown in FIG. 1. The apparatus receives performance data input of a melody (principal part) from a melody keyboard and generates as a response tones of the principal part by an internal tone generator. In addition, the apparatus receives data of a chord progression, one chord at a time, from an accompaniment keyboard. The apparatus uses the principal part and chord progression information to generate an additional part. A past rhythm (tone durational succession) of the principal part serves as a basis for a current rhythm of the additional part. To correct possible timing errors in the principal part performed by the melody keyboard, the rhythm of the principal part is quantized in accordance with a feature of the third embodiment. The time-quantized principal part rhythm recurs with a time lag (e.g., one-bar time delay) as a current rhythm of the additional part. A current pitch of the additional part is specified by a current chord member closest to a past pitch of the principal part. The additional part combined with the principal part will provide a polyphonic "canon" music.

An overall arrangement of the third embodiment is illustrated in FIG. 11. Because FIG. 1 has been described in connection with the first embodiment, further description is omitted here.

FIG. 20 shows main variables referenced and used by CPU4 of the third embodiment. T indicates a current time. CR variable indicates a current chord root pitch. CT indicates a current chord type. Thus, the current chord is represented by CR and CT. The contents of CR and C7 are updated each time a new chord is supplied from the accompaniment keyboard (chord progression providing means). EL is a register for storing a current pitch of the additional part. MD0[] represents a melody (principal part) array for storing the performed principal part actually supplied from the melody keyboard. The array MD0[] has a predetermined number of elements (e.g., 96) spanning a predetermined amount of a musical time (e.g., one-bar time). The first element of MD0[] indicates a state of the principal part at the start of a one bar while the last element of MD0[] indicates a principal part state at the end of the bar. MD1[] is a melody array after rhythm-quantizing the original melody array MD0[]. CKT[] indicates a chord member look-up table such as the one shown in FIG. 4.

Data type of CT is a chord type the meaning of which is shown in FIG. 3 and has been described in the first embodiment. Data type of T is an interger. The remaining variables are each represented by melody type data the meaning of which is also shown in FIG. 3.

Figure 21:
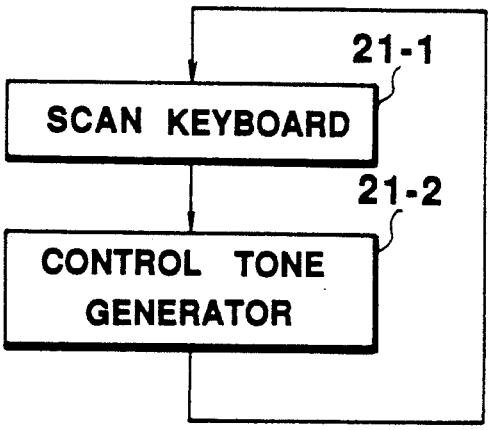
FIG. 21 is a flow chart of a main routine in the third embodiment.

FIG. 21 shows a main routine of the third embodiment. The main routine comprises block 21-1 for scanning the keyboard 2 and block 21-2 for controlling the tone generator 6. Only the tones of the principle part are sounded by the block 21-2. Tones of the additional part are controlled in a time interrupt routine shown in FIG. 22.

Figure 22:
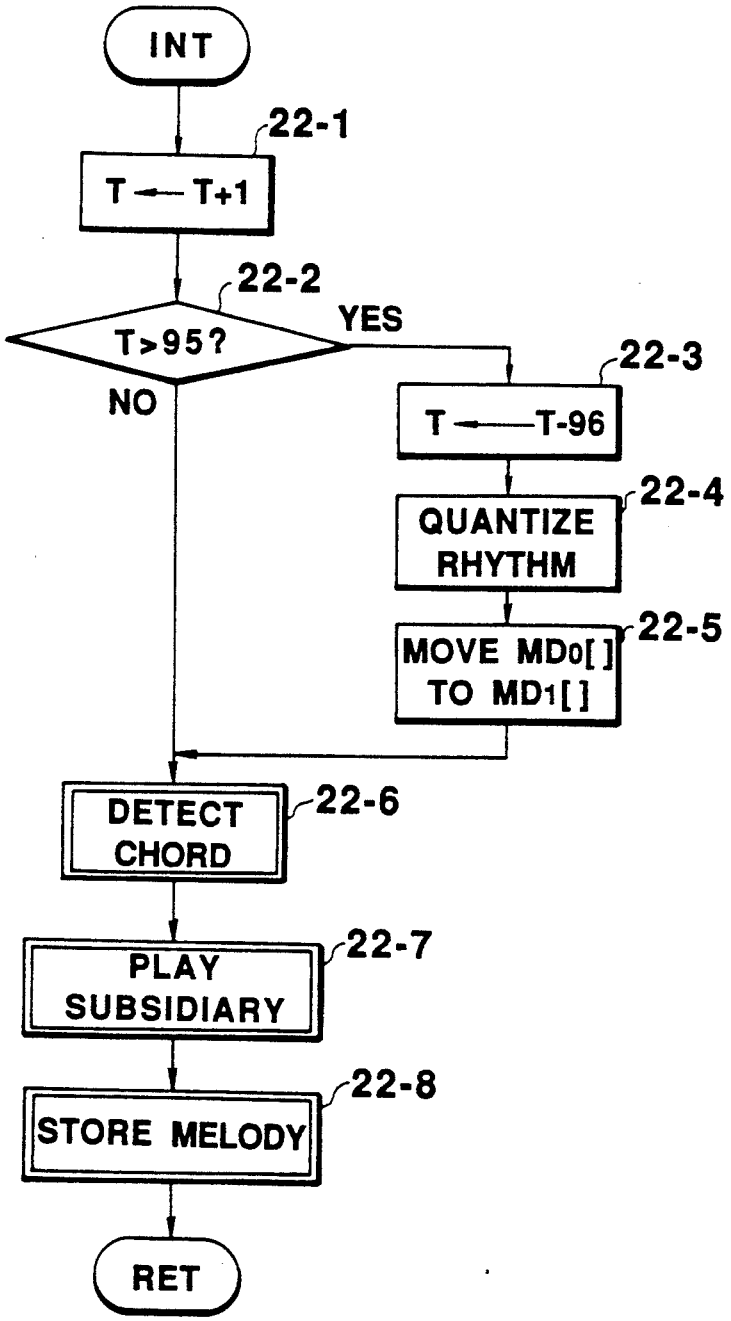
FIG. 22 is a flow chart of a time interrupt routine in the third embodiment.

The time interrupt routine of FIG. 22 is periodically executed at a rate corresponding to the musical time resolution of the system (e.g., 96 times a bar). Block 22-1 increments the current time T. If T has exceeded 95 (22-2), this indicates when a one-bar time has elapsed. Then, 96 is subtracted from T (22-3) so that T will point to the bar line time. Then block 22-4 quantizes the rhythm of the principal part stored in the one-bar melody array MD0[]. Block 22-5 copies the quantized principal part data into the array MD1[].

Then, the time interrupt routine executes Detect Chord procedure 22-6, Play Subsidiary procedure 22-7 and Store Melody procedure 22-8.

The Detect Chord procedure 22-6 operates in the manner described earlier according to the flowchart of FIG. 8 to detect and store a current chord from the accompaniment keyboard into CT (current type) and CR (current root) registers.

Figure 24:
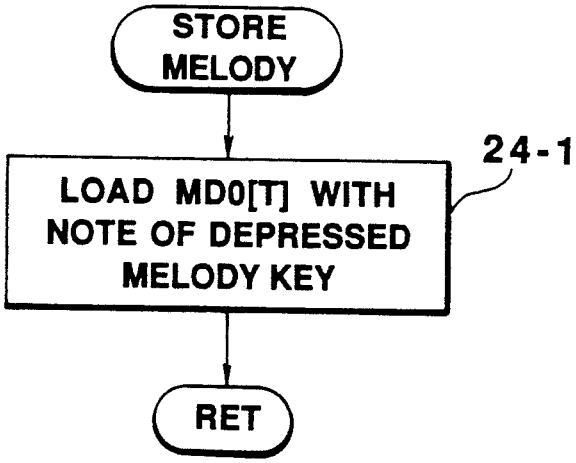
FIG. 24 is a flow chart of a Store Melody routine in the third embodiment.

The Store Melody procedure 22-8 operates in the same manner as described according to the flowchart of FIG. 24 to store a melody note into a current melody array element MD0[T] (24-1).

Figure 23:
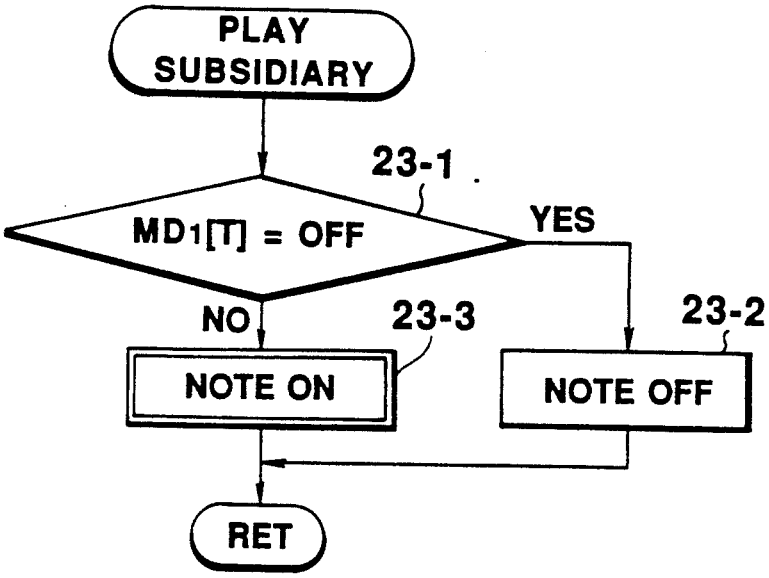
FIG. 23 is a flow chart of a Play Subsidiary routine in the third embodiment.

FIG. 23 shows a flowchart of the Play Subsidiary routine 22-7. Block 23-1 tests to see if a rhythm-quantized melody array element MD1[T] at a one-bar past time point indicates an off state. If so, Note-off procedure 23-2 is executed for the additional part. If MD1[T] indicates a pitch, Play Subsidiary routine executes Note-on procedure 23-3.

In this manner, the additional part rhythm follows the time-quantized principal part rhythm with a one-bar time delay.

Figure 25:
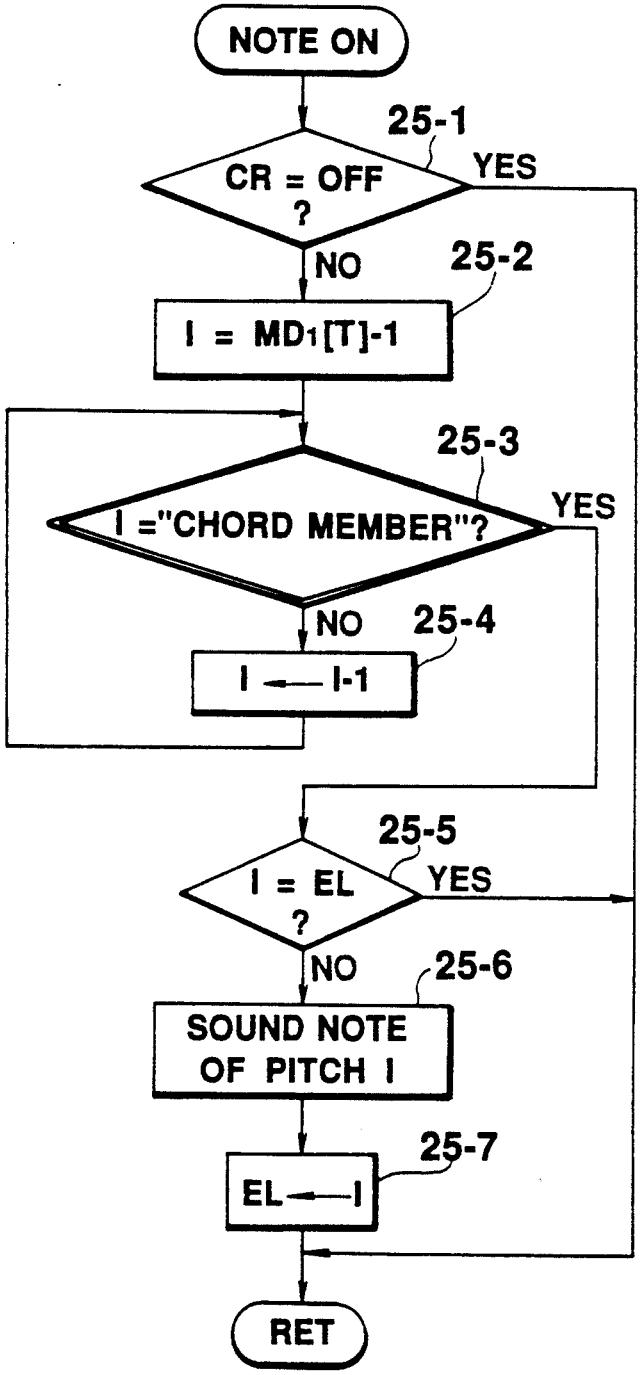
FIG. 25 is a flow chart of a Note-on routine in the third embodiment.

FIG. 25 shows details of the additional part note-on routine 23-3. If there is no current chord as indicated by CR=OFF (25-1), the note-on routine 23-3 terminates directly. If a current chord exists, the routine searches for a current pitch for the additional part in blocks 25-2 to 25-4. Specifically, the block 25-2 initializes a pitch candidate I to a semitone below a time-quantized principal part pitch MD1[T] at a one-bar past time point. The loop of 25-3 and 25-4 decrements pitch candidate I until a member of a current chord is found. This chord member, which is closest to and below the quantized principal part pitch MD1[T], defines a current pitch of the additional part.

Figure 26:
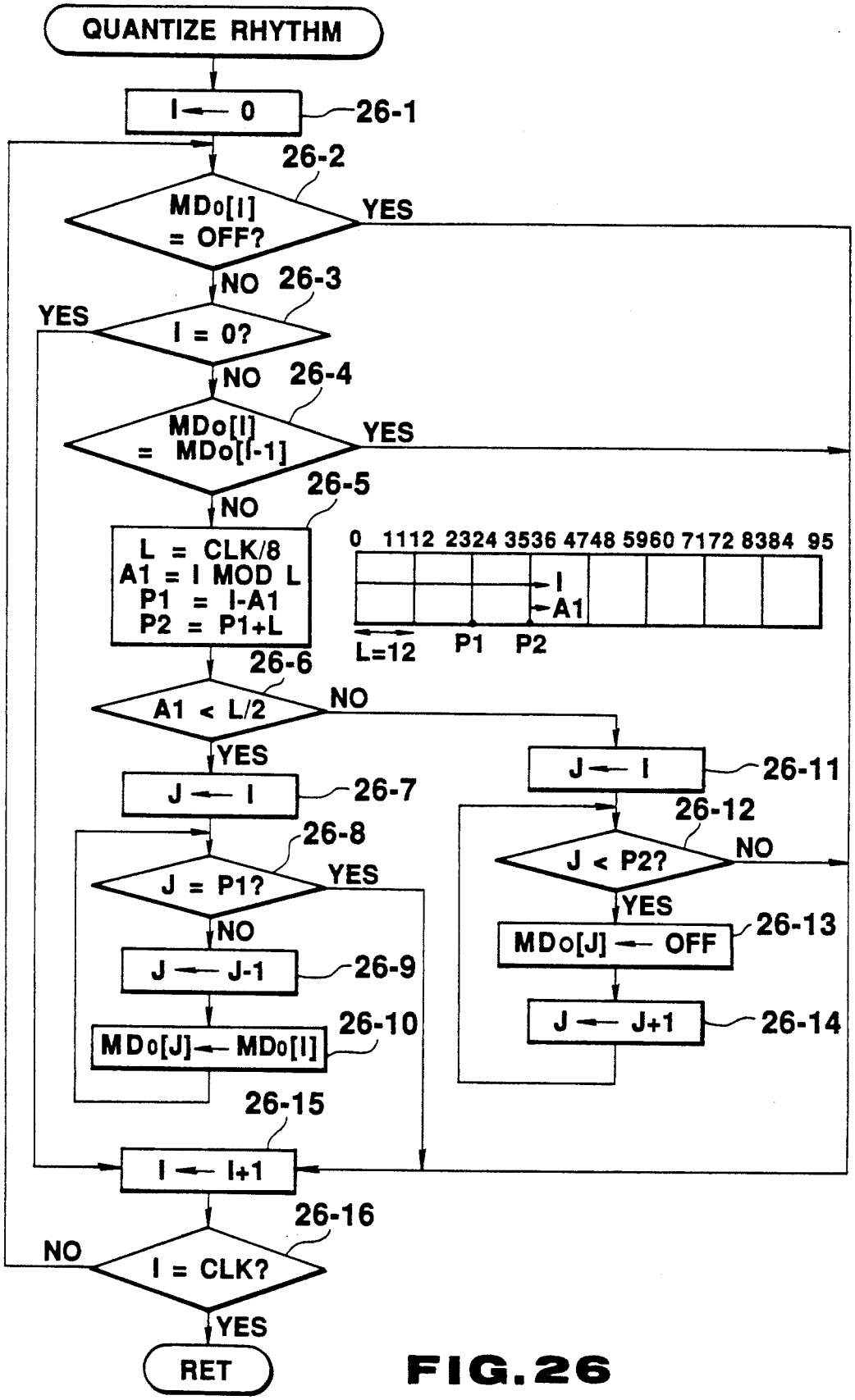
FIG. 26 is a flow chart of a Quantize Rhythm routine in the third embodiment.
Figure 27:
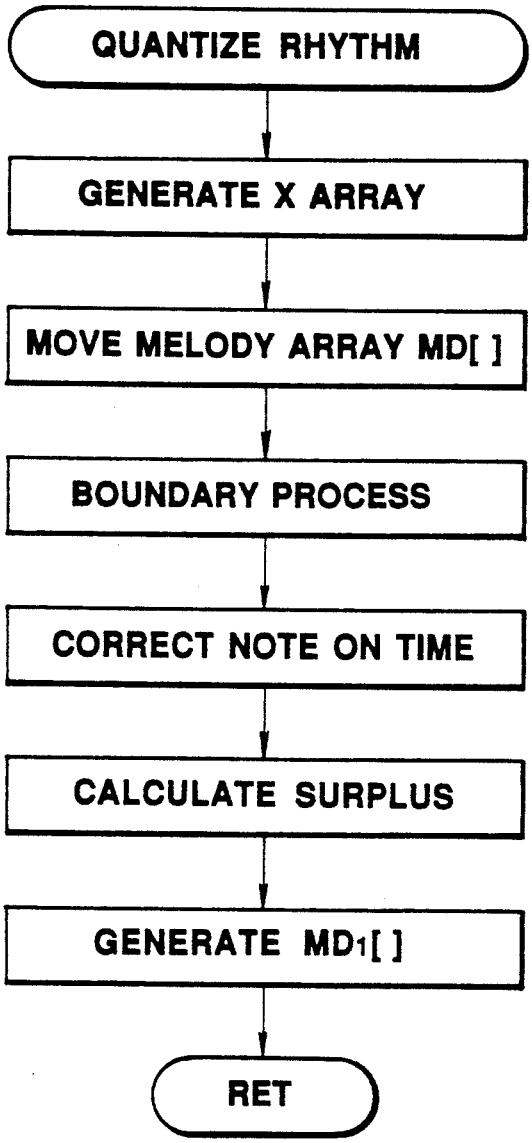
FIGS. 27 to 33 are flow charts of quantizing the rhythm of a principal part for use in a modification of the third embodiment.

FIG. 26 shows details of the Quantize Rhythm routine 22-4 in accordance with a feature of the third embodiment. The purpose of this routine is time-quantize the principal part rhythm stored in the melody array MD0[] for the additional part. This routine supports a quantized additional part rhythm in which each additional note-on can occur at one of a plurality of discrete musical time points. To this end, Quantize Rhythm routine corrects erroneously timed note-on events in the original principal part that occurred out of the discrete time points so that the resultant note-on events occur at desired discrete time pointes. In this example, the discrete time points are specified by eight equal subdivisions of a one-bar length. Each note-on event in the original principal part is quantized to its nearest discrete point.

More specifically, block 26-1 initializes a pointer I for the performed or original melody array MD0[] to the first element MD0[0]. In the following process, I pointer is successively incremented in the range of 0 to CLK or 96 (26-15, 26-16) to scan all original melody array elements. If an original melody array element MD0[I] indicates a pitch rather than an off state (26-2), if that element MD0[I] is not the first element MD0[0] (26-3), and if that element MD0[I] indicates a different pitch from the immediately preceding element MD0[I-1] (26-4), then, a note-on event with a pitch of MD0[I] occurred at the time point I has been detected. Upon detection of a note-on event in the actually performed principal part, block 26-5 calculates several variables including the discrete time interval L between adjacent discrete points given by CLK/8, the time deviation A1 of the detected note-on event from the immediately preceding discrete time point (where A1=I mod L), the immediately preceding discrete time point P1(=I−A1), and the immediately succeeding discrete time point P2 (=P1+L). Then block 26-6 compares the time deviation A1 with half the discrete time interval (L/2). If A1<L/2, Quantize Rhythm routine changes (quantizes) the note-on time I to the immediately preceding discrete time point P1. To this end, the note-on time I is copied into J register (26-7). Those melody array elements in the range of J=P1 to F (26-8, 26-10) are loaded with pitch data MD0[I] of the note-on event (26-9). If A1>=L/2, Quantize Rhythm routine changes the detected note-on time to its next succeeding discrete time point P2. To this end, the detected note-on time I is copied into J register (26-11). Those melody array elements in the range of J=I to (P2−1) are all loaded with an off state (26-12 to 26-14).

In this manner, each note-on timing in the actually performed principal part is quantized to its nearest discrete time point thus forming a time-quantized principal part. The time quantized principal part data are copied into the array MD1[] at a bar-line time (22-5). The copied quantized principal part is used to generate and play an additional part. As a result, the additional part will have a rhythm that follows the quantized rhythm of the principal part with a one-bar time delay to produce an effect of "canon" music.

MODIFICATIONS OF THE THIRD EMBODIMENT

The third embodiment has been described. Various modifications will be obvious to those skilled in the art in accordance with the teachings of the invention.

In the third embodiment, the Quantize Rhythm routine (FIG. 26) detects note-on events in the actually performed principal part and corrects occurrence times of the detected note-on events to desired discrete time points. The routine, however, does not make any corrections of the occurrence times of the note-off events.

The routine may be modified to correct the occurrence times of both note-on and note-off events in the performed principal part while maintaining the respective note durations. Such a modification is illustrated in the flow charts of FIGS. 27 to 33.

The modified Quantize rhythm routine (FIG. 27) is periodically executed each time when a predetermined amount of time (e.g., half of one bar or two-beat time) has elapsed. The performed melody array MD[] may store the origianl (unquantized) principal part data from a one-bar past time to a current time. First the Quantize Rhythm routine detects those note-on events in the unquantized principal part that occurred at a time between the one-bar past time and two-beat subsequent time (selectively plus a eighth note time i.e., ⅛ of one bar) to generate X array. The generated X array stores each note event data comprising note-on time, note duration and note pitch at three successive addresses; the note-on time of a detected note is stored at an address J=0 mode 3, the duration of the detected note at the next address (J+1), the pitch of the note at the next address (J+2).

Figure 28:
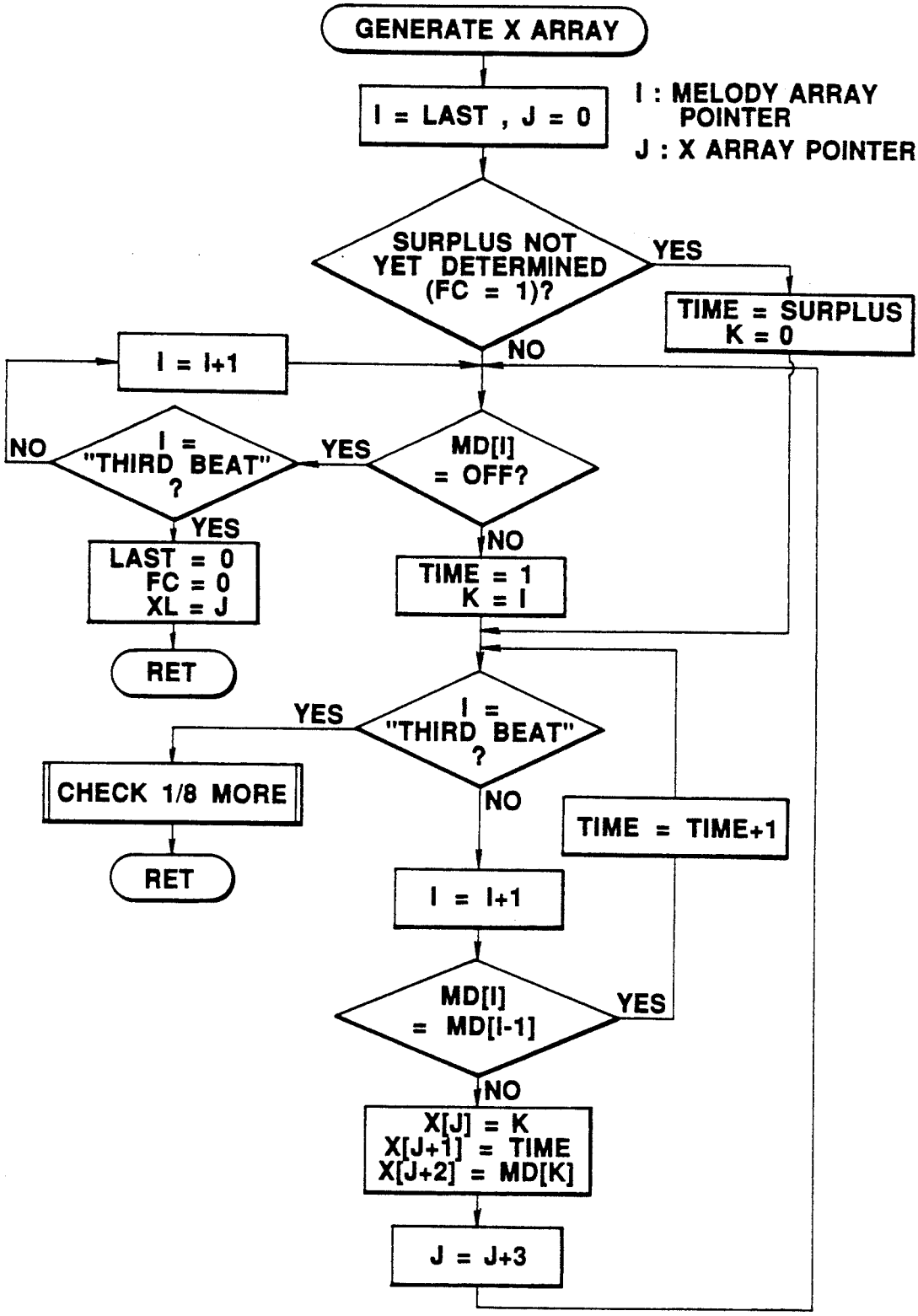
Figure 29:
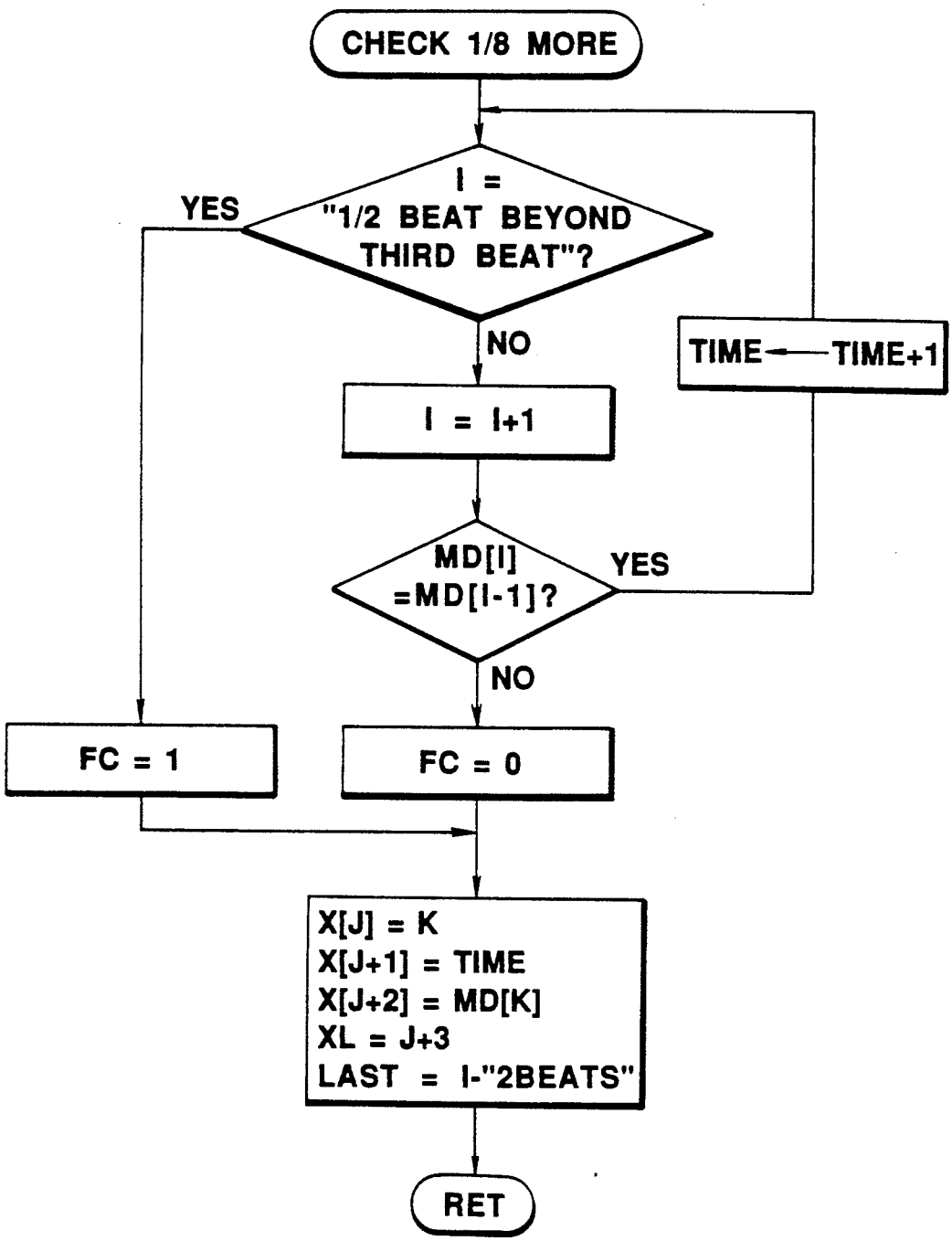
Figure 30:
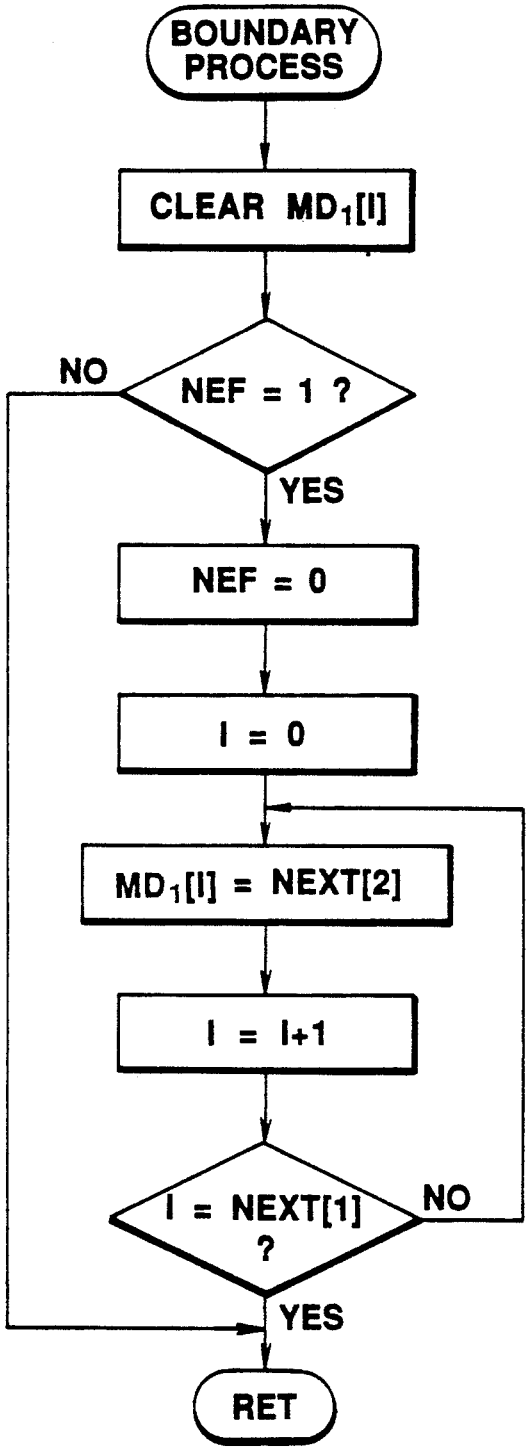
Figure 31:
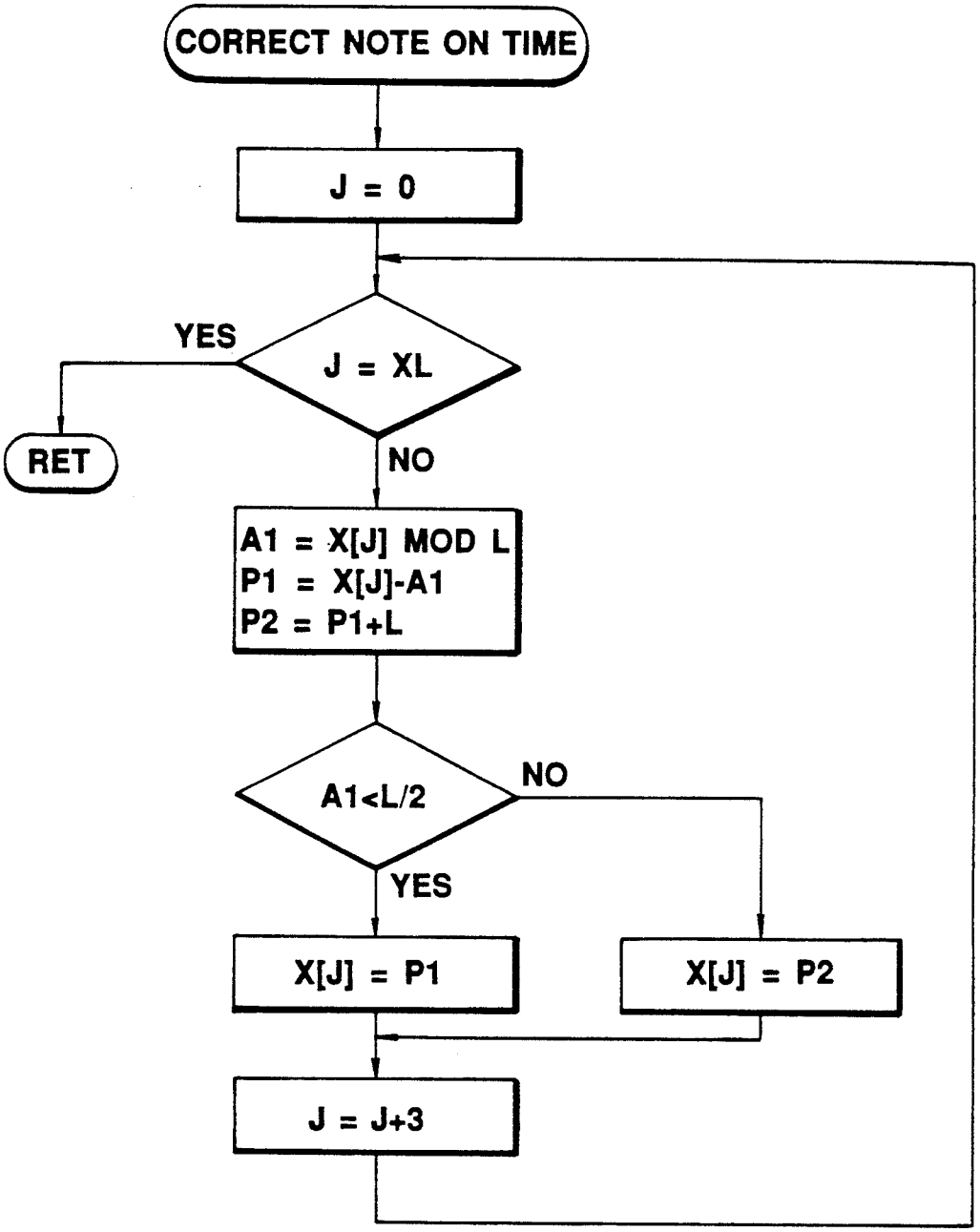
Figure 32:
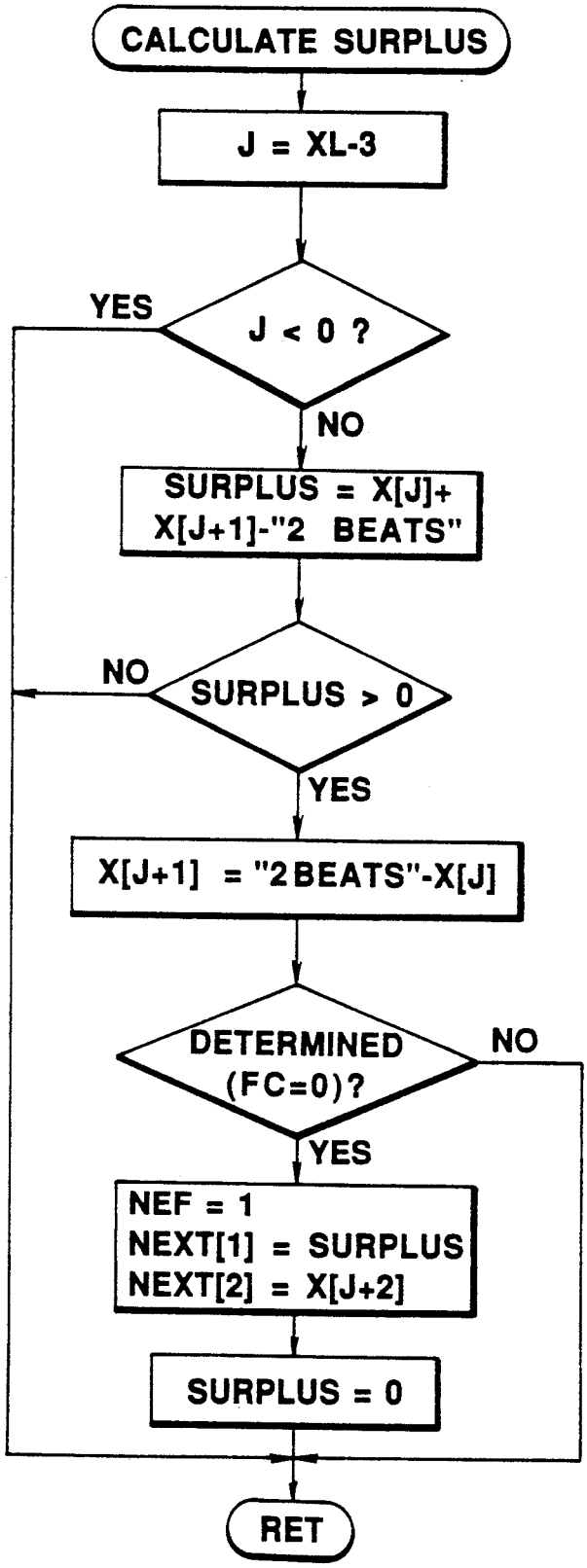
Figure 33:
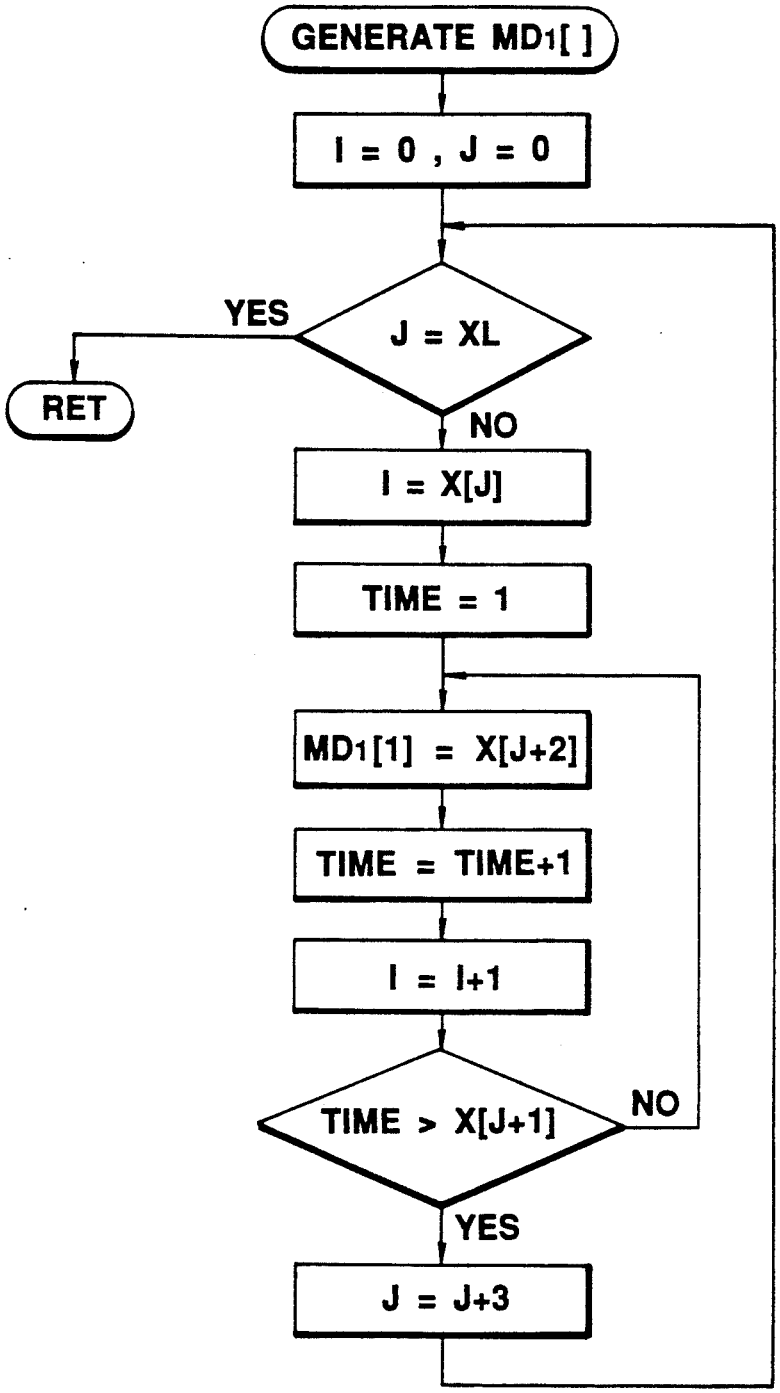

More specifically, in Generate X Array subroutine of FIG. 28, a melody array pointer I is moved from LAST position to the start of the third beat if the melody array MD[] indicates an off state (absence of note) at the beginning of the third beat. In the meantime, each time it detects a note-on event from the melody array MD[], the subroutine records the occurrence time into J, measures the duration of the note into (J+1) and stores the pitch of the note into (J+2). If the melody array MD[] indicates a presence of a note at the start of the third beat, Generate X Array subroutine executes "check ⅛ More (FIG. 29)" to search for a note-off event of that (last) note. If detected, the last note duration has been determined with FC=0. If the last note continues even when the search has reached a point ½ beat beyond the third beat, the last note remains undetermined with FC=1.

After a two-beat time has passed, Generate X Array subroutine is executed again. If the last note remains undetermined, the subroutine initializes TIME to SURPLUS of the undetermined note to continue measuring the duration of the undetermined note.

After X array is generated, Move Melody Array MD[] subroutine is executed to move forward the contents of X array by two beats in preparation for the next creation of X array.

Then Boundary Process (FIG. 30) checks if the last determined note has a durational portion NEXT [1] extending beyond the boundary between the previous and current two-beat segments. If this is the case, the Boundary Process loads the last note pitch data NEXT[2] with those elements of a quantized principal part melody array MD1[] which cover the extending durational portion NEXT [1] of the last note.

Then, Correct Note-on Time subroutine (FIG. 31) is executed. This routine quantizes each note-on event in the X array to the nearest discrete time (P1 or P2) in the same manner as described in the third embodiment.

Then, Calculate Surplus subroutine (FIG. 32) is executed. This subroutine retrieves the last note from the X array with the quantized note-on times, subdivides the duration of the last note into a portion belonging to the current two-bar segment (which portion will be reloaded into X[J+1]) and a portion belonging to the next two-bar segment. Further, if the duration of the last note has been determined (FC=0), the subroutine sets NEF=1, NEXT[1]="SURPLUS" i.e., the durational portion of the last note assigned to the next segment, and NEXT[2]=last note pitch X[J+2] so that the boundary process will be properly performed at the next pass. If the last note duration remains undetermined, the value of SURPLUS calculated here will be referenced by Generate X Array subroutine to generate X array for the next segment.

Finally, Generate MD1[] subroutine (FIG. 33) generates the quantized melody array MD1[] in accordance with the contents of the X array. Pitch data X[J+2] of a note are written into those elements of MD1[] starting from the note-on time X[J] of that note and covering the duration X[J+1] of that note.

With this arrangement, both note-on and note-off occurrence times of notes in the actually performed principal part are quantized while maintaining their durations.

The discrete time points and/or the manner of quantization discribed in the third embodiment is illustrative only. For example, discrete time points may have unequal time spacings therebetween which might be suitable for rhythm background of music. Each detected note-on time points are not necessarily quantized to its nearest discrete time point in an absolute and physical sense. For example, K×L may substitute for L/2 in 26-6 in FIG. 26 in which K is a user-programmable parameter and has a desired value between 0 and 1.

The time difference between the principal and additional part may have any other desired time value.

What is claimed is:

1. An apparatus for generating an additional musical part which is to be played simultaneously with a principal melodic part of a music piece, the apparatus comprising:

principal part providing means for providing a principal melodic part of a music piece;

pitch set succession providing means for providing a succession of pitch sets available in an additional part of said music piece;

control parameter generating means for generating control parameters for each melodic line of said additional part to be played simultaneously with said principal melodic part; and additional part generating means for generating said additional part having at least one melodic line based on said principal melodic part, said succession of pitch sets and said control parameters;

said control parameter generating means including pointer generating means for generating a pointer that points to a segment of said principal melodic part at a past time; and said additional part generating means including determining means for determining a current content of said additional part by referencing said segment of said principal melodic part pointed to be said pointer.

2. The apparatus as claimed in claim 1, wherein:

said principal part providing means comprises principal part input means for inputting performance data of said principal melodic part on a real-time basis, and principal part storing means for storing said performance data from said principal part input means;

said pitch set succession providing means comprises chord progression input means for inputting data of a chord progression of said music piece on a real time basis, and current chord detecting means responsive to said chord progression input means for detecting a current chord; and said additional part generating means includes means for generating said additional part on a real-time basis;

and wherein the apparatus further comprises principal part output means responsive to said principal part input means for outputting tones of said principal melodic part, and additional part output means responsive to said additional part generating means for outputting tones of said additional part.

3. An apparatus for generating an additional musical part which is to be played simultaneously with a principal melodic part of a music piece, the apparatus comprising:

principal part providing means for providing a principal melodic part of a music piece;

pitch set succession providing means for providing a succession of pitch sets available in an additional part of said music piece;

control parameter generating means for generating control parameters for each melodic line of said additional part to be played simultaneously with said principal melodic part; and additional part generating means for generating said additional part having at least one melodic line based on said principal melodic part, said succession of pitch sets and said control parameters;

said control parameter generating means including pointer generating means for generating pointers pointing to a plurality of different segments of said principal melodic part; and said additional part generating means including determining means for determining a current content of said additional part by referencing said plurality of different segments of said principal melodic part pointed to be said pointers.

4. An apparatus for generating an additional musical part which is to be played simultaneously with a principal melodic part of a music piece, the apparatus comprising:

principal part providing means for providing a principal melodic part of a music piece;

pitch set succession providing means for providing a succession of pitch sets available in an additional part of said music piece;

control parameter generating means for generating control parameters for each melodic line of said additional part to be played simultaneously with said principal melodic part; and additional part generating means for generating said additional part having at least one melodic line based on said principal melodic part, said succession of pitch sets and said control parameters;

said control parameter generating means including pointing means for pointing to at least one segment of said principal melodic part which is selected from a past segment, a future segment or a plurality of segments, of said principal melodic part; and said additional part generating means including pitch determining means for determining a current pitch of said additional part by referencing at least one segment of said principal melodic part pointed to by said pointing means.

5. An apparatus for generating a musical part comprising:

first part providing means for providing a first part, of a music piece;

control parameter generating means for generating control parameters for a second part of said music piece to be added to said first part; and second part generating means for generating said second part based on said first part and said control parameters;

wherein said control parameter generating means comprises pointing means for pointing to at least one segment of said first part which is selected from a past segment, a future segment or a plurality of segments, of said first part; and wherein said second part generating means comprises rhythm determining means for determining a current rhythm of said second part from said at least one segment of said first part pointed to by said pointing means.

6. The apparatus as claimed in claim 5 wherein at least one of said first part and said second part is a percussion instrument part.

* * * * *